US010139139B2

(12) United States Patent
Jeong et al.

(10) Patent No.: US 10,139,139 B2
(45) Date of Patent: Nov. 27, 2018

(54) REFRIGERATION CYCLE AND REFRIGERATOR HAVING THE SAME

(71) Applicants: SAMSUNG ELECTRONICS CO., LTD., Suwon-si, Gyeonggi-do (KR); KOREA UNIVERSITY RESEARCH AND BUSINESS FOUNDATION, Seoul (KR)

(72) Inventors: Hee Moon Jeong, Yongin-si (KR); Seong Ho Kil, Seongnam-si (KR); Seok Uk Kim, Suwon-si (KR); Keon Kuk, Yongin-si (KR); Yong Chan Kim, Seoul (KR); Jae Jun Lee, Seoul (KR); Yong Seok Jeon, Seoul (KR)

(73) Assignees: SAMSUNG ELECTRONICS CO., LTD., Suwon-si (KR); KOREA UNIVERSITY RESEARCH AND BUSINESS FOUNDATION, Seoul (KR)

( * ) Notice: Subject to any disclaimer, the term of this patent is extended or adjusted under 35 U.S.C. 154(b) by 0 days.

(21) Appl. No.: 15/511,851

(22) PCT Filed: May 21, 2015

(86) PCT No.: PCT/KR2015/005078
§ 371 (c)(1),
(2) Date: Mar. 16, 2017

(87) PCT Pub. No.: WO2016/043407
PCT Pub. Date: Mar. 24, 2016

(65) Prior Publication Data

US 2017/0292740 A1 Oct. 12, 2017

(30) Foreign Application Priority Data

Sep. 18, 2014 (KR) ..... 10-2014-0124355

(51) Int. Cl.
*F25B 29/00* (2006.01)
*F25B 49/02* (2006.01)
(Continued)

(52) U.S. Cl.
CPC ..... *F25B 29/003* (2013.01); *F25B 5/02* (2013.01); *F25B 5/04* (2013.01); *F25B 9/08* (2013.01);
(Continued)

(58) Field of Classification Search
CPC ..... F25B 2341/0011; F25B 2341/0012; F25B 2341/066; F25B 2341/0662;
(Continued)

(56) References Cited

U.S. PATENT DOCUMENTS 2,415,243 A * 2/1947 Hickman ..... F25B 39/02 138/44
5,357,766 A * 10/1994 Shiraishi ..... F24F 1/0003 62/197
(Continued)

FOREIGN PATENT DOCUMENTS

| | | |
|---|---|---|
| JP | 2006-234225 | 9/2006 |
| JP | 2006-292351 | 10/2006 |
| KR | 10-2012-0085071 | 7/2012 |

OTHER PUBLICATIONS

International Search Report dated Aug. 24, 2015 in corresponding International Patent Application No. PCT/KR2015/005078.
(Continued)

*Primary Examiner* — Christopher R Zerphey
(74) *Attorney, Agent, or Firm* — Staas & Halsey LLP

(57) ABSTRACT

Disclosed herein is a refrigeration cycle includes a first refrigerant circuit configured to cause a refrigerant ejected from a compressor to flow through a condenser, an ejector, a first evaporator, and a second evaporator and flow back to
(Continued)

the compressor; a second refrigerant circuit configured to cause the refrigerant to bypass the first evaporator in the first refrigerant circuit; and a third refrigerant circuit branching at a junction provided at a downstream end of the condenser from at least one of the first refrigerant circuit and the second refrigerant circuit, and configured to cause the refrigerant to flow through an expansion device and a third evaporator and flow to the ejector. By such configuration, a coefficient of performance (COP) of a refrigeration cycle may be improved and an ejector may be used to improve energy efficiency.

19 Claims, 15 Drawing Sheets

(51) Int. Cl.

| | |
|---|---|
| ***F25D 17/02*** | (2006.01) |
| ***F25B 40/04*** | (2006.01) |
| ***F25B 9/08*** | (2006.01) |
| ***F25D 11/00*** | (2006.01) |
| ***F25D 17/04*** | (2006.01) |
| ***F25B 5/02*** | (2006.01) |
| ***F25B 5/04*** | (2006.01) |
| ***F25B 40/06*** | (2006.01) |
| *F24F 5/00* | (2006.01) |
| *F25B 13/00* | (2006.01) |
| *F25B 40/00* | (2006.01) |

(52) U.S. Cl.
CPC ..... *F25B 40/04* (2013.01); *F25B 40/06* (2013.01); *F25B 49/02* (2013.01); *F25B 49/027* (2013.01); *F25D 11/00* (2013.01); *F25D 17/04* (2013.01); *F24F 5/00* (2013.01); *F25B 13/00* (2013.01); *F25B 40/00* (2013.01); *F25B 2400/0403* (2013.01); *F25B 2400/0409* (2013.01)

(58) Field of Classification Search
CPC ..... F25B 2400/0411; F25B 2400/052; F25B 2400/054
See application file for complete search history.

(56) References Cited

U.S. PATENT DOCUMENTS

| | | | | |
|---|---|---|---|---|
| 8,047,018 | B2 * | 11/2011 | Ikegami | F25B 41/00 62/170 |
| 2006/0254308 | A1 * | 11/2006 | Yokoyama | B60H 1/3205 62/500 |
| 2007/0119207 | A1 | 5/2007 | Oshitani et al. | |
| 2007/0163294 | A1 | 7/2007 | Aung et al. | |
| 2008/0098757 | A1 | 5/2008 | Takeuchi et al. | |
| 2010/0162751 | A1 | 7/2010 | Nishijima et al. | |

OTHER PUBLICATIONS

PCT/ISA/237 dated Aug. 24, 2015 in corresponding International Patent Application No. PCT/KR2015/005078.
Extended European Search Report dated Mar. 15, 2018, in corresponding European Patent Application No. 15842675.9.

* cited by examiner

[Fig. 1]
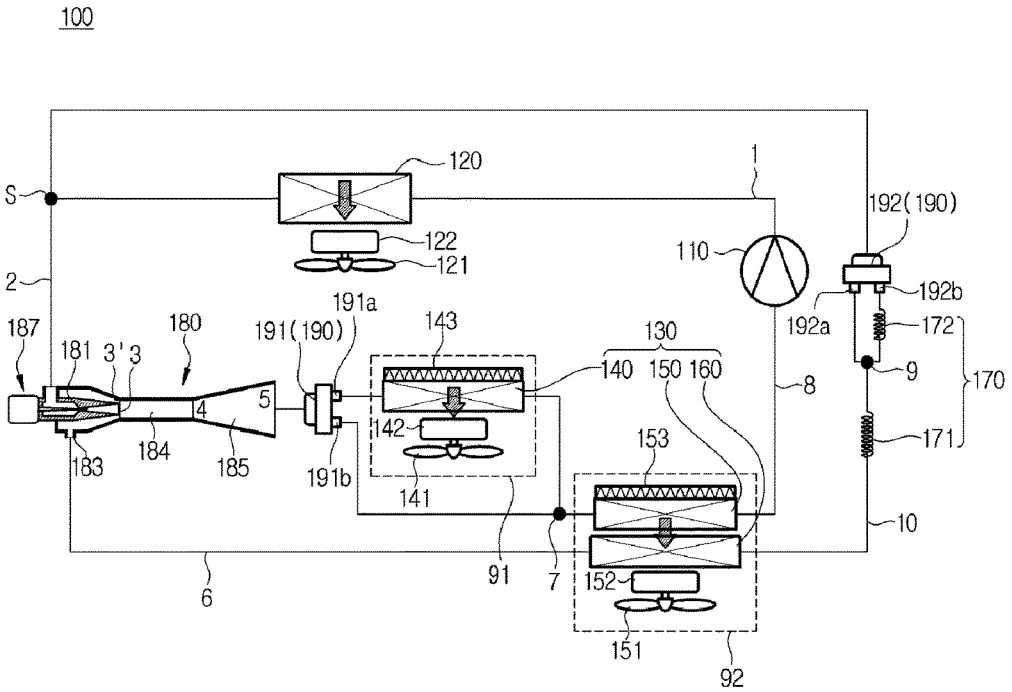
[Fig. 2A]
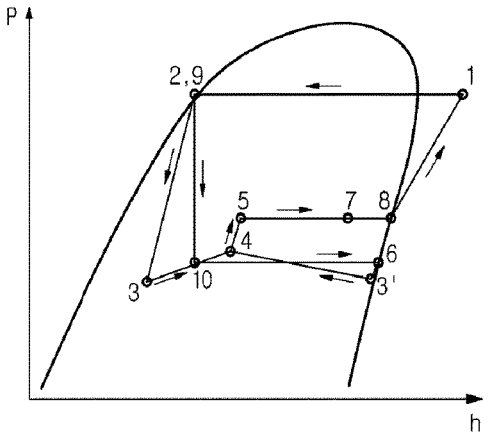
[Fig. 2B]
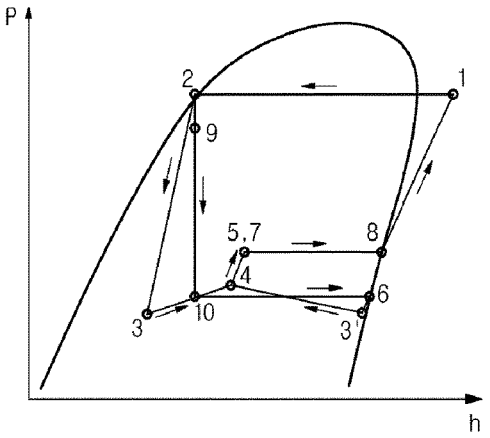

[Fig. 3]
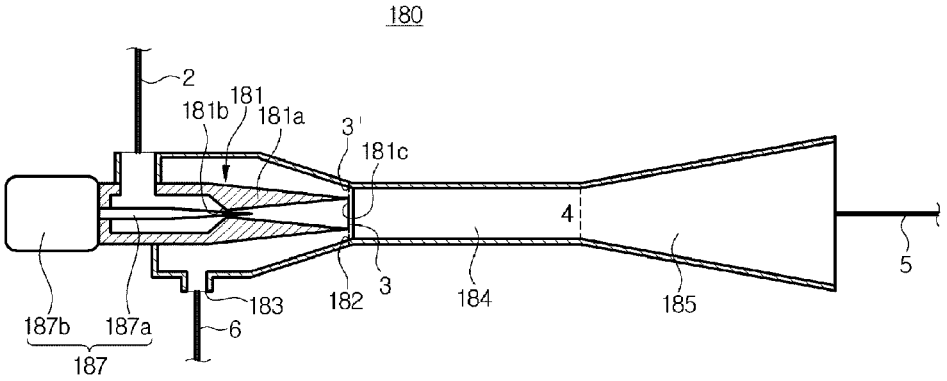
[Fig. 4]
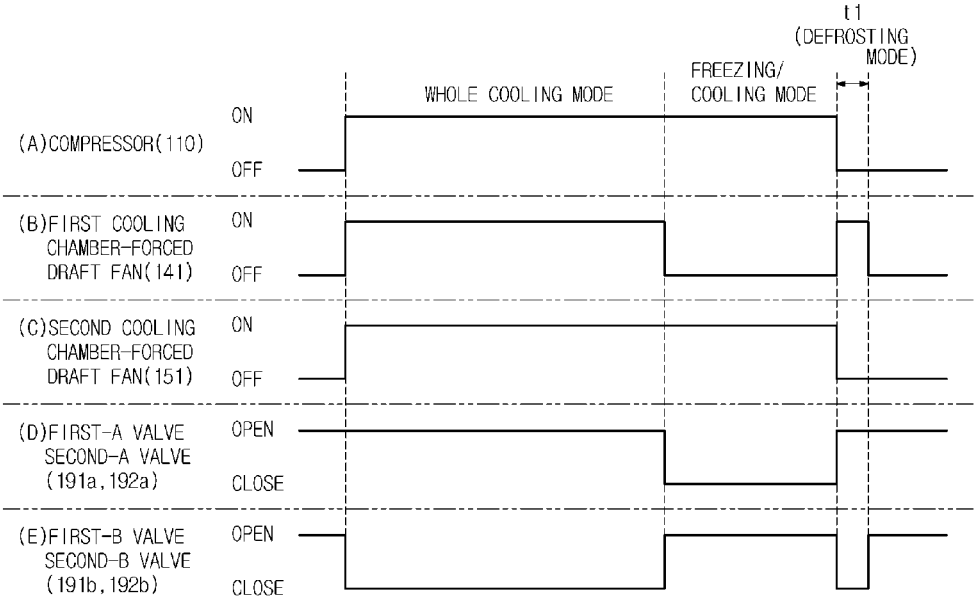

[Fig. 5]
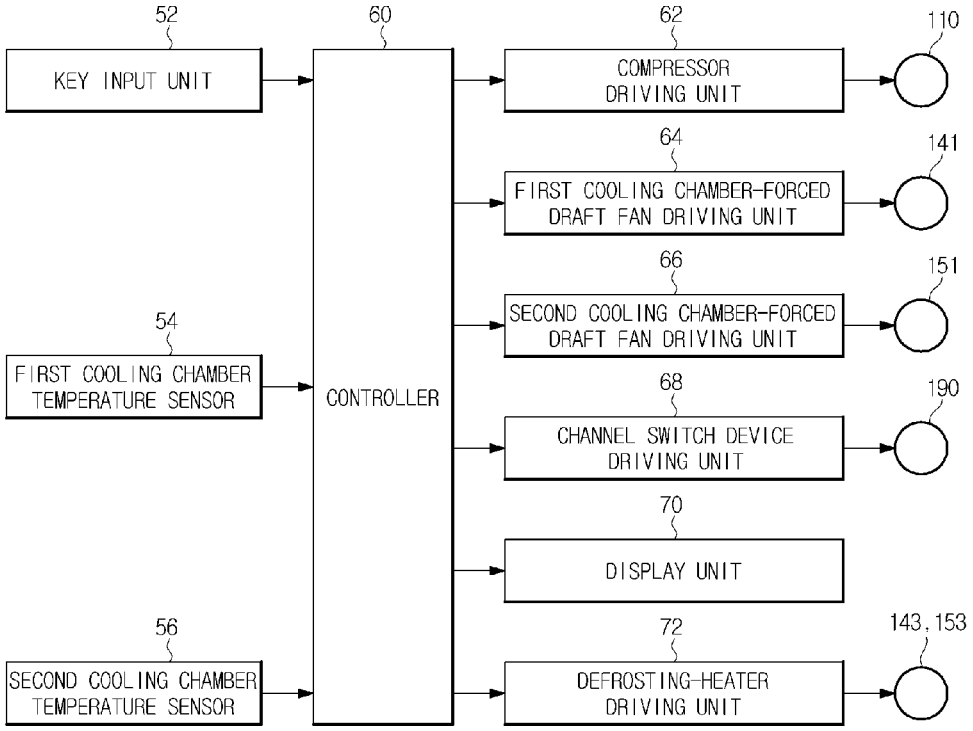

[Fig. 6a]
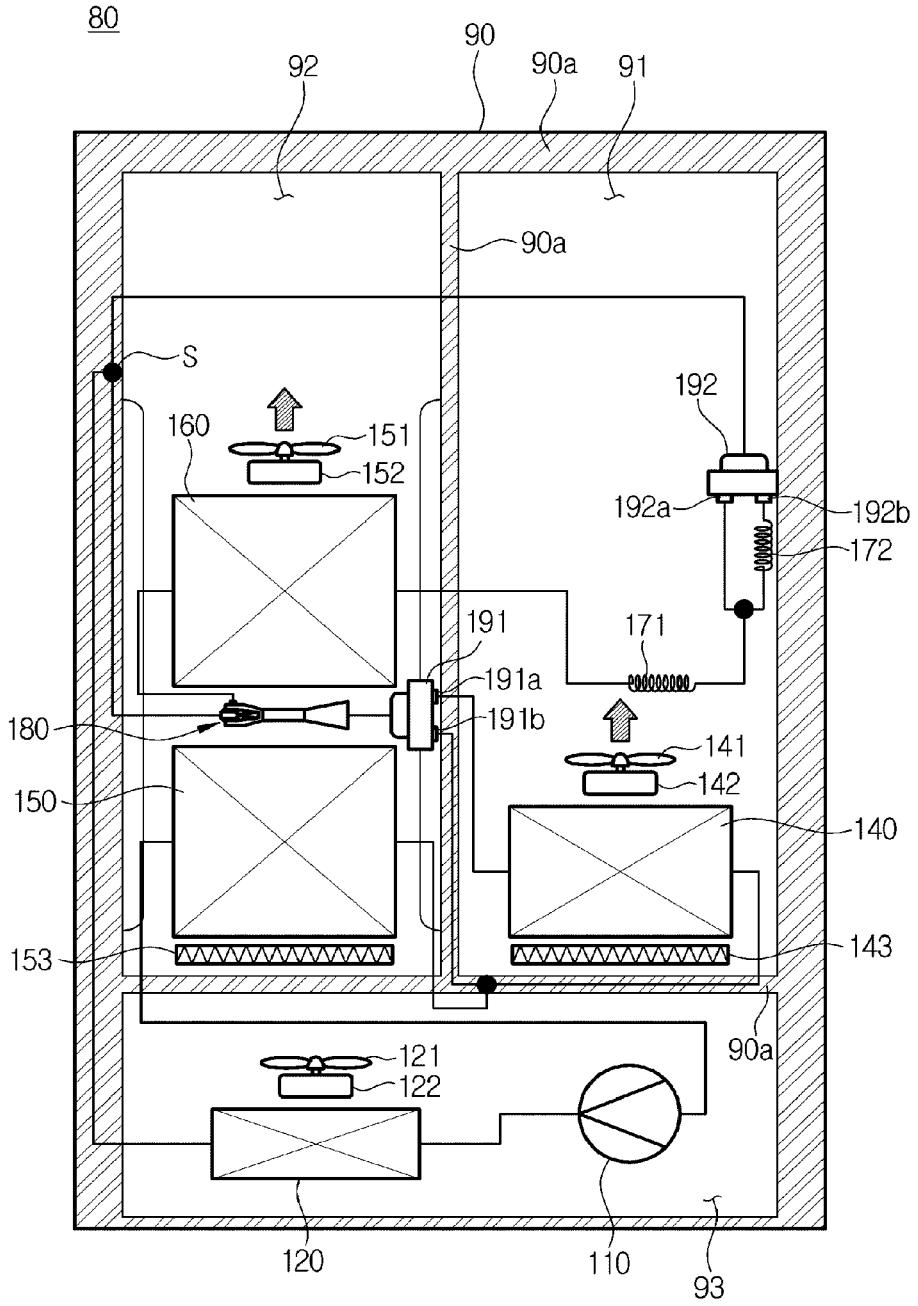

[Fig. 6b]
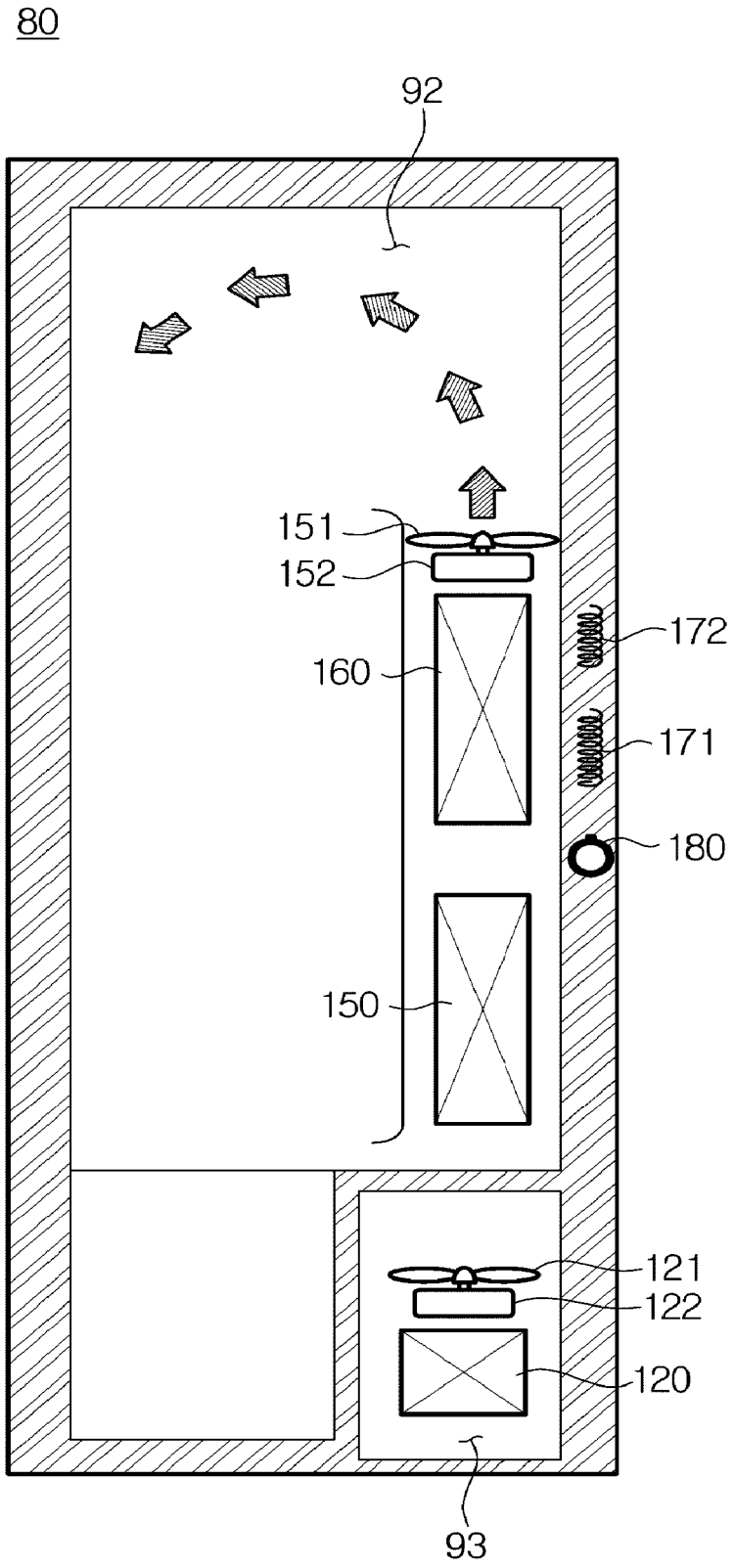

[Fig. 7]
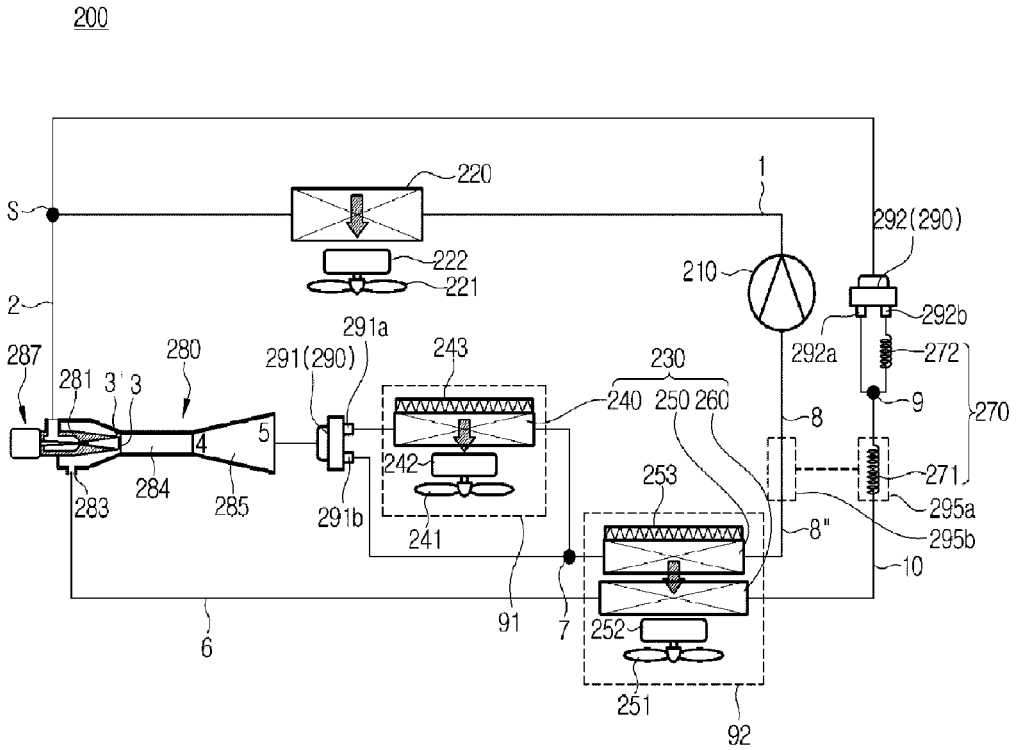
[Fig. 8A]
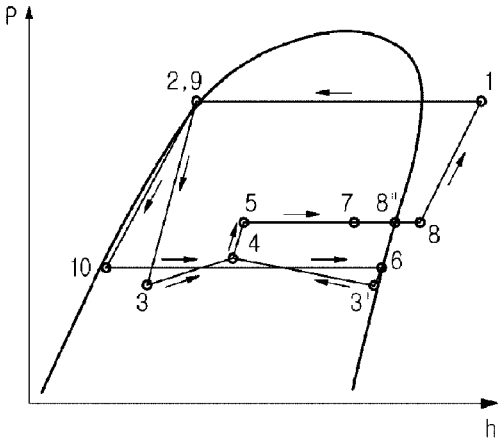
[Fig. 8B]
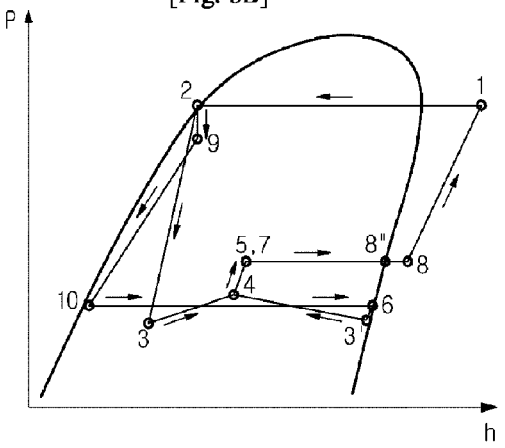

[Fig. 9]
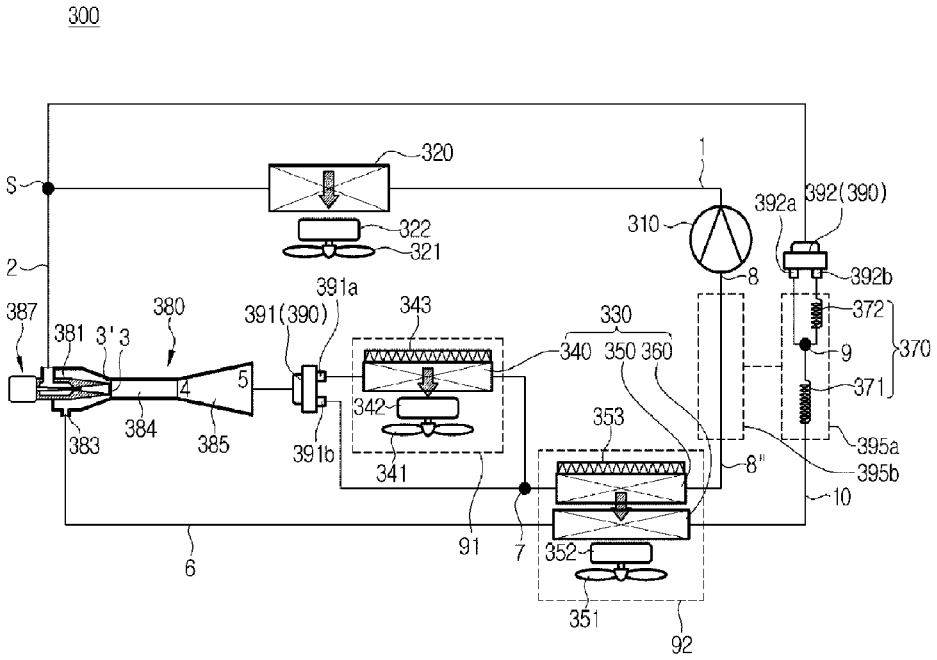
[Fig. 10A]
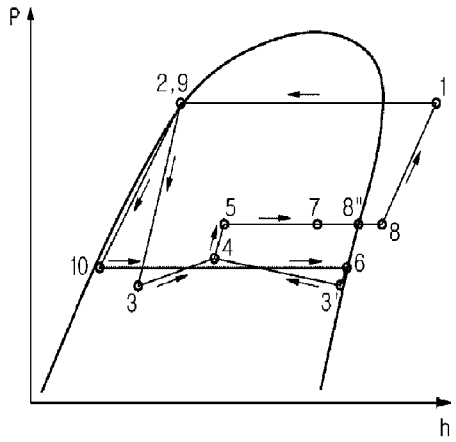
[Fig. 10B]
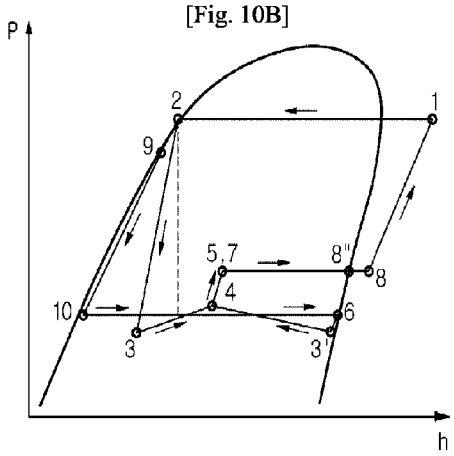

[Fig. 11]
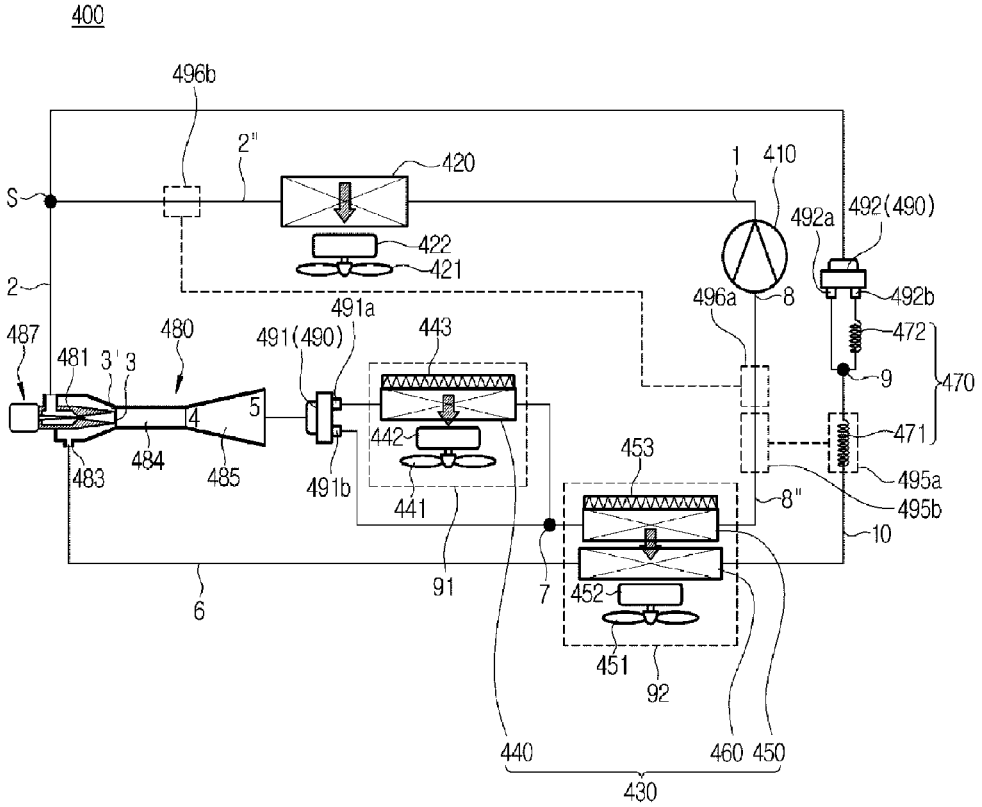
[Fig. 12A]
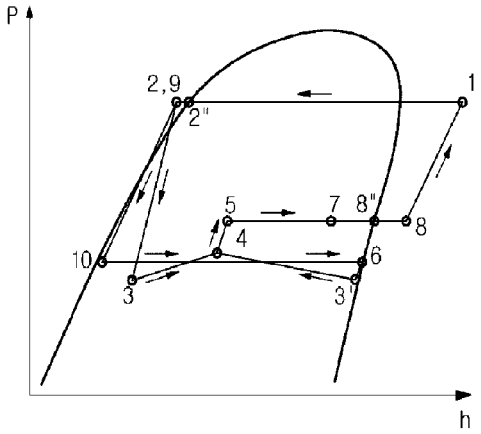
[Fig. 12B]
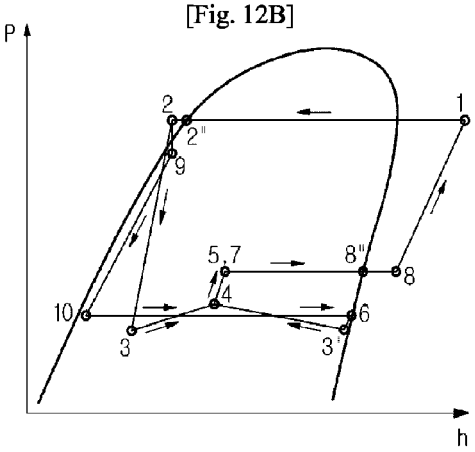

[Fig. 13]
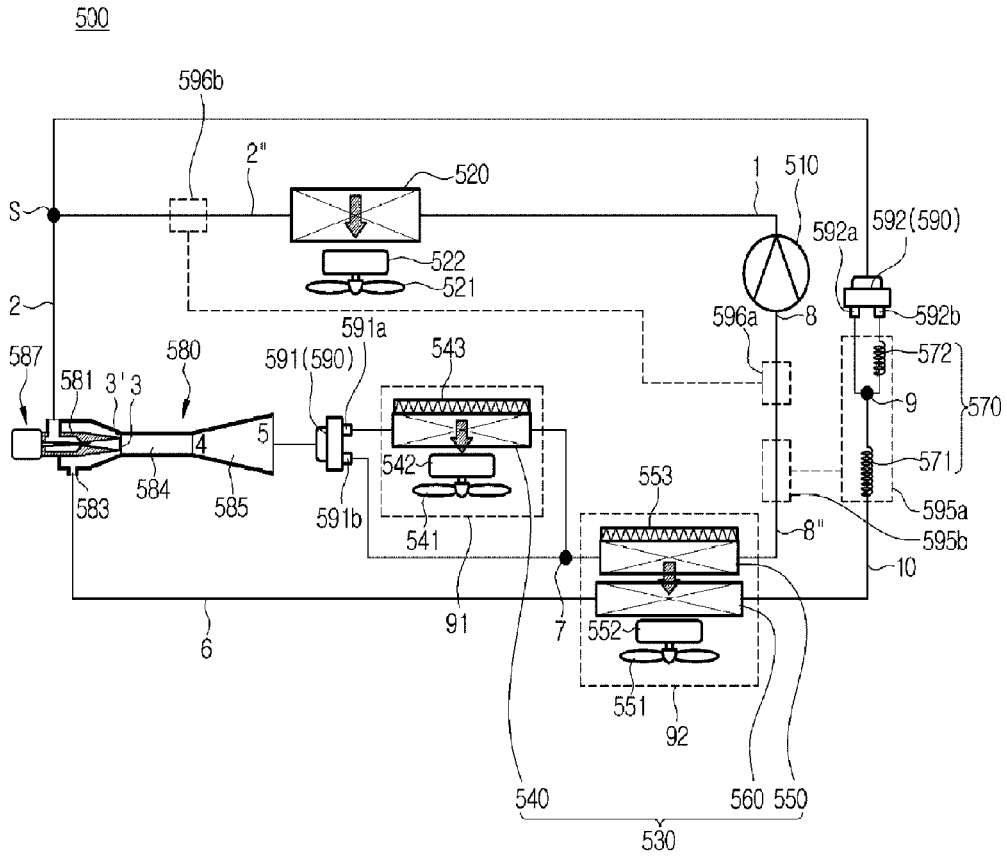
[Fig. 14A]
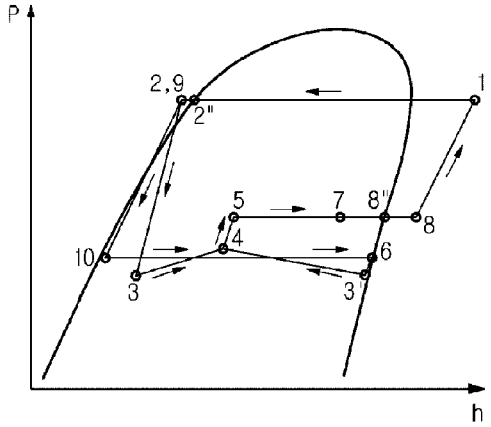
[Fig. 14B]
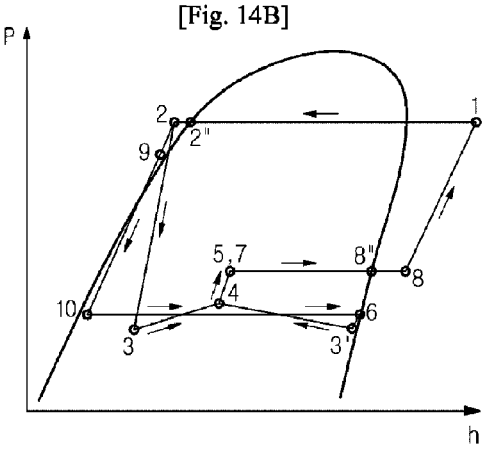

[Fig. 15]
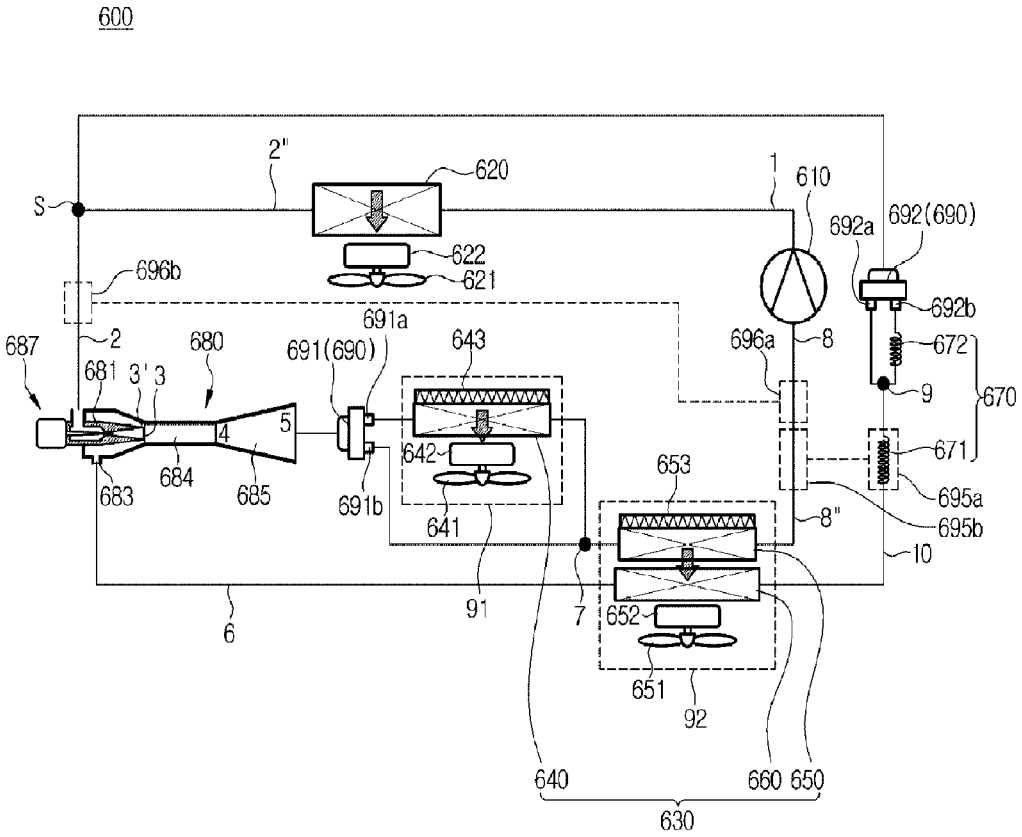
[Fig. 16A]
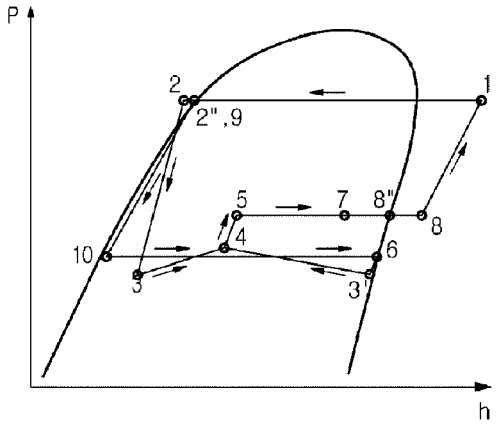
[Fig. 16B]
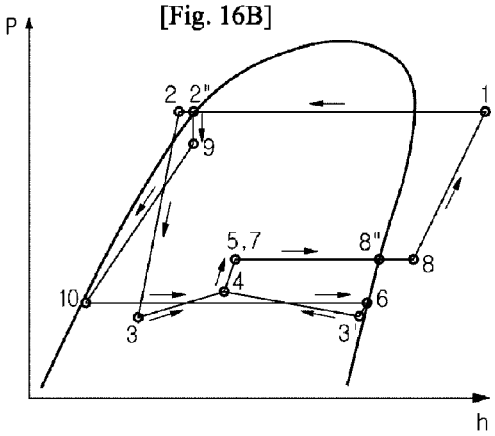

[Fig. 17]
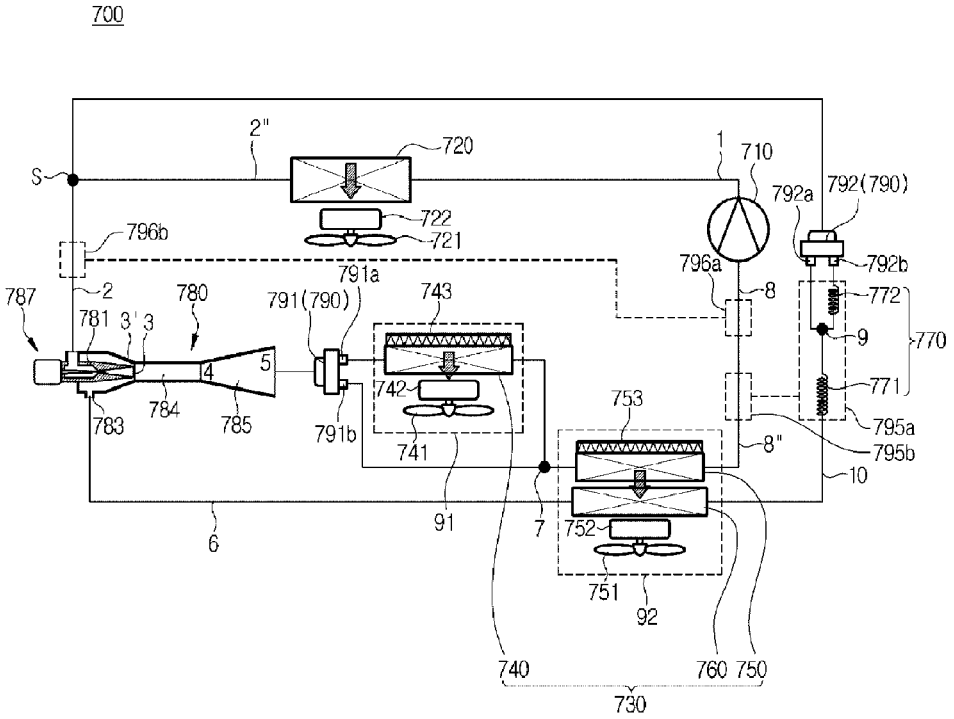
[Fig. 18A]
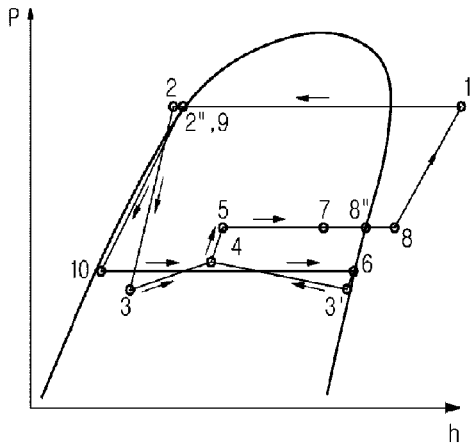
[Fig. 18B]
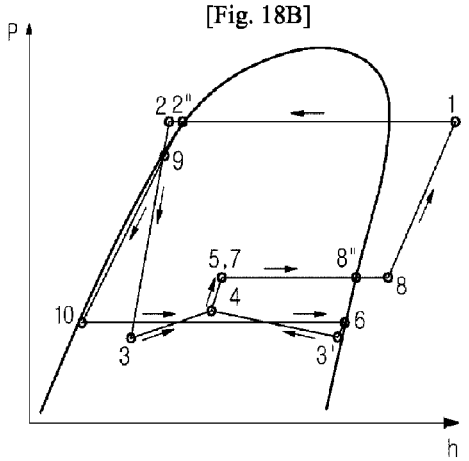

[Fig. 19]
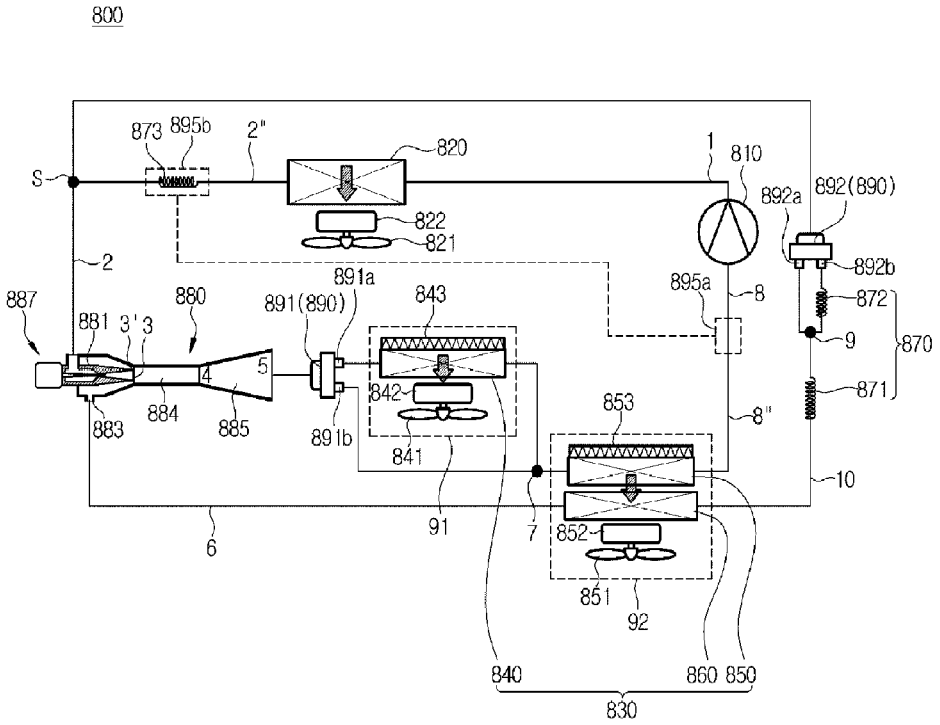
[Fig. 20A]
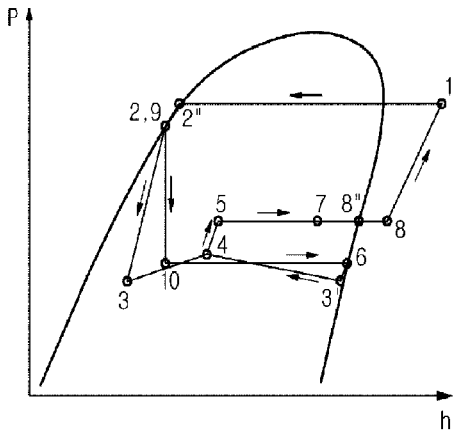
[Fig. 20B]
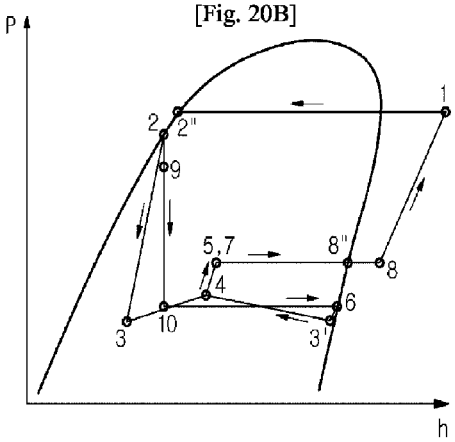

[Fig. 21]
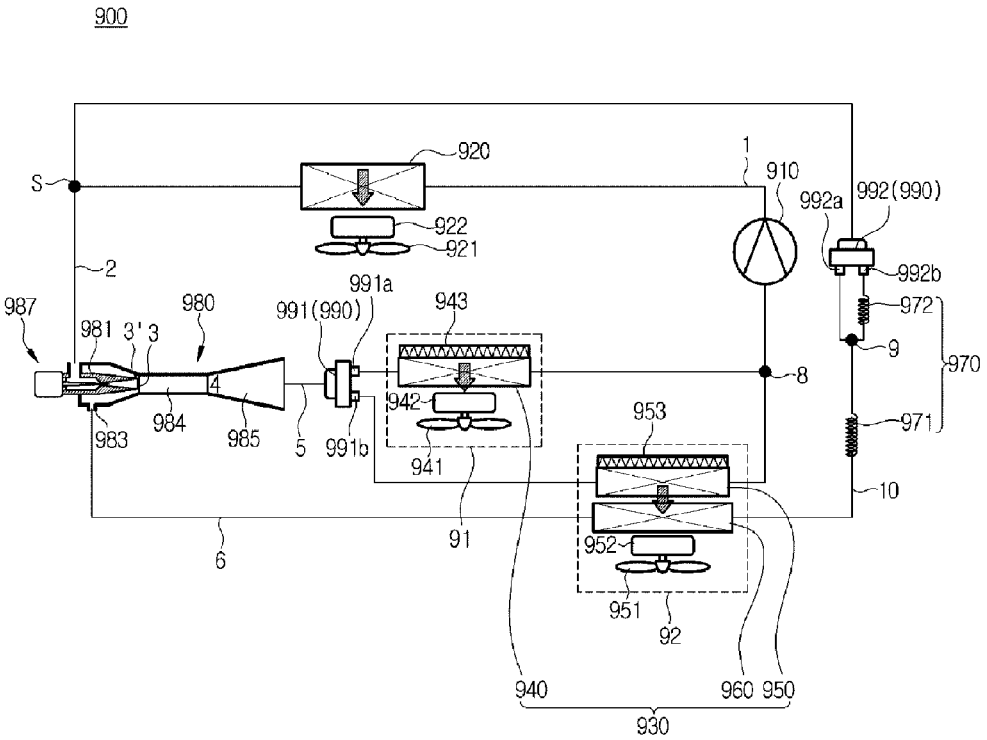
[Fig. 22A]
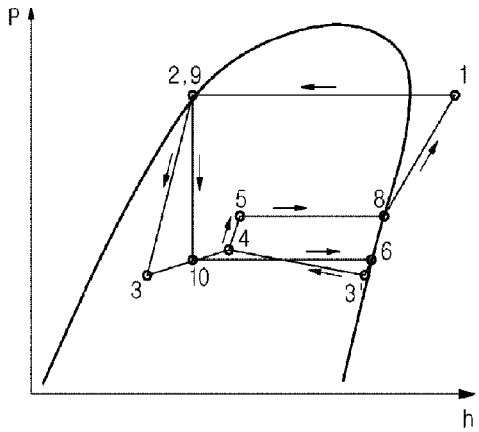
[Fig. 22B]
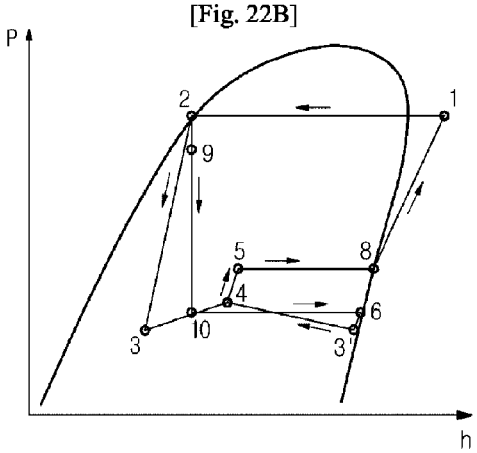

[Fig. 23]
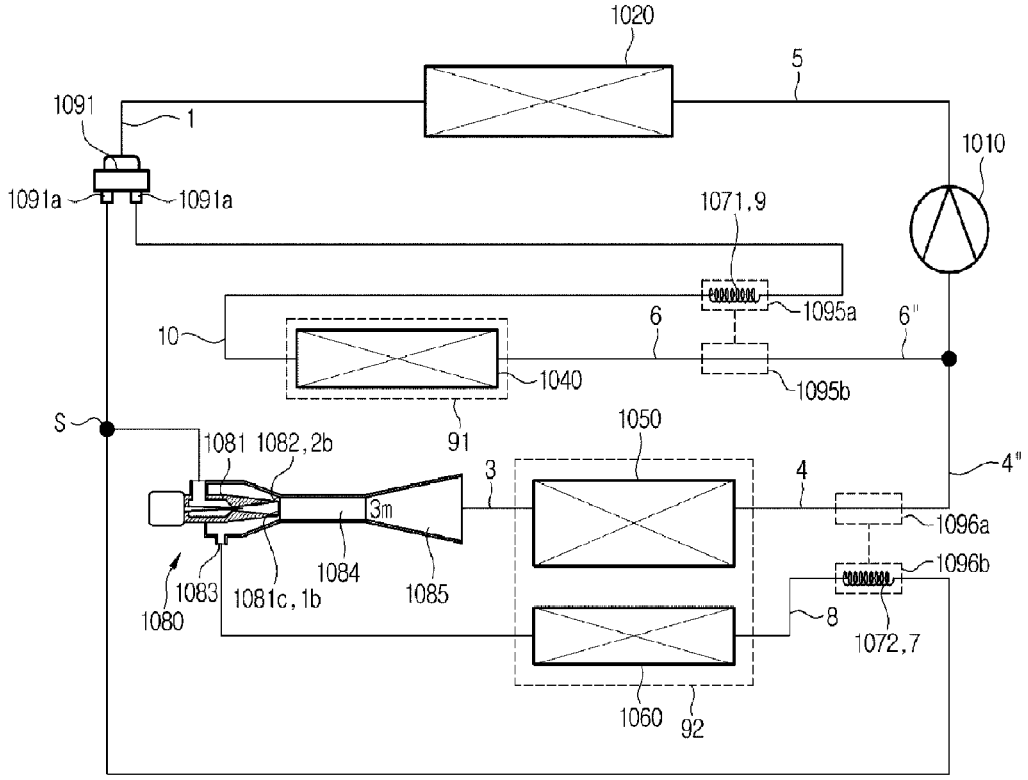

[Fig. 24]
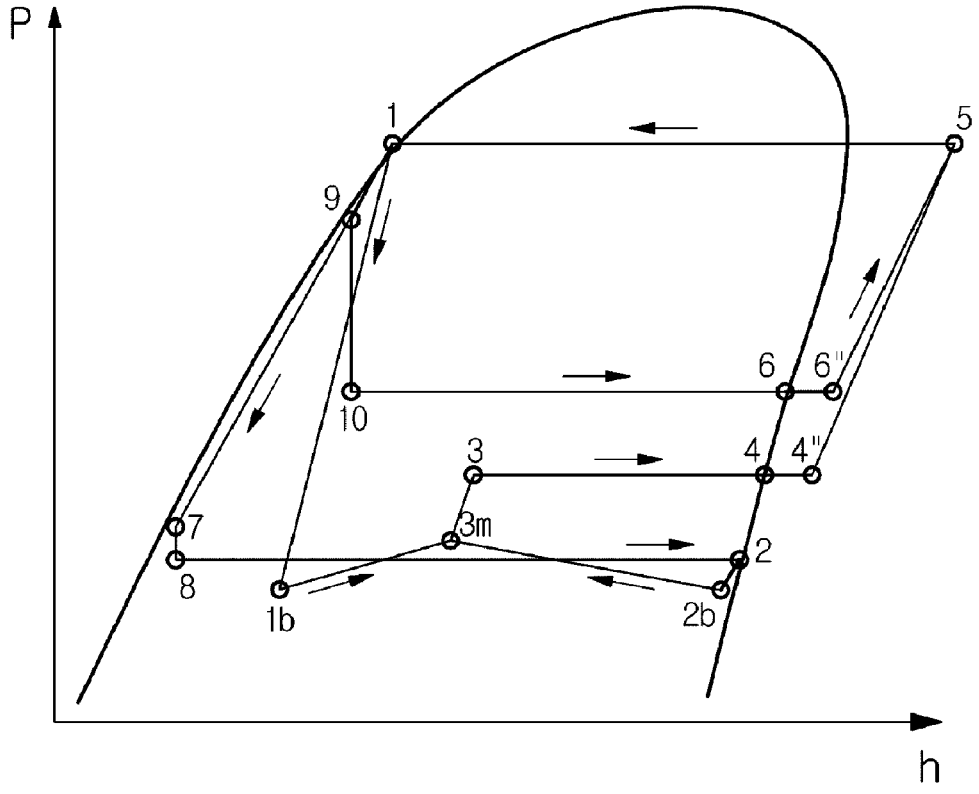

REFRIGERATION CYCLE AND REFRIGERATOR HAVING THE SAME

CROSS-REFERENCE TO RELATED APPLICATIONS

This application is a U.S. National Stage Application, which claims the benefit under 35 U.S.C. § 371 of PCT International Patent Application No. PCT/KR2015/005078, filed May 21, 2015, which claims the foreign priority benefit under 35 U.S.C. § 119 of Korean Patent Application No. 10-2014-0124355, filed Sep. 18, 2014, the contents of which are incorporated herein by reference.

TECHNICAL FIELD

The present invention relates to a refrigeration cycle and a refrigerator having the same, and more particularly, to a refrigeration cycle having an improved coefficient of performance (COP) and a refrigerator having the refrigeration cycle.

BACKGROUND ART

In a cooling apparatus having two or more cooling chambers, these cooling chambers are divided by a middle partition and are opened or closed using a door. Furthermore, each of these cooling chambers includes an evaporator which generates cool air and a fan which blows the cool air into the cooling chamber. Each of these cooling chambers is independently cooled through actions of the evaporator and the fan thereof. This cooling method is referred to as an independent cooling method. There is a refrigerator having a freezer and a refrigeration chamber as a representative example of a cooling apparatus to which the independent cooling method is applied. The freezer of the refrigerator is mainly used to store frozen food. It has been generally known that an appropriate temperature of the freezer is about −18° C. In contrast, the refrigeration chamber is used to store general food and drink which need not be cooled at room temperature of 0° C. or more. It has been known that an appropriate temperature of the refrigeration chamber is about 3° C.

Although the refrigeration chamber and the freezer are different in terms of appropriate temperature, evaporative temperatures of a first evaporator and a second evaporator of a conventional refrigerator are the same. Thus, a fan of the freezer is consecutively driven, and a fan of the refrigeration chamber is intermittently driven to blow cool air into the refrigeration chamber when needed, thereby preventing an internal temperature of the refrigeration chamber from being lowered to more than necessary.

DISCLOSURE

Technical Problem

One aspect of the present invention is directed to a refrigeration cycle having an improved coefficient of performance (COP) and a refrigerator having the refrigeration cycle.

Technical Solution

In accordance with a first aspect of the present invention, a refrigeration cycle includes a first refrigerant circuit configured to cause a refrigerant ejected from a compressor to flow through a condenser, an ejector, a first evaporator, and a second evaporator and flow back to the compressor; a second refrigerant circuit configured to cause the refrigerant to bypass the first evaporator in the first refrigerant circuit; and a third refrigerant circuit branching at a junction provided at a downstream end of the condenser from at least one of the first refrigerant circuit and the second refrigerant circuit, and configured to cause the refrigerant to flow through an expansion device and a third evaporator and flow to the ejector.

The refrigerant flows through the first refrigerant circuit or the second refrigerant circuit, and the third refrigerant circuit.

Which is operated in a whole cooling mode and a freezing/cooling mode, wherein the refrigerant flows through the first refrigerant circuit and the third refrigerant circuit in the whole cooling mode, and the refrigerant flows through the second refrigerant circuit and the third refrigerant circuit in the freezing/cooling mode.

The expansion device includes a first expansion device; and a second expansion device disposed in series with the first expansion device, and the third refrigerant circuit comprises: a third-a refrigerant circuit configured to cause the refrigerant to pass through the first expansion device provided at an upstream end of the third evaporator; and a third-b refrigerant circuit configured to cause the refrigerant to pass through the first expansion device and the second expansion device.

In the whole cooling mode, at least a portion of the refrigerant flowing through the first refrigerant circuit circulates through the third-a refrigerant circuit, and in the freezing/cooling mode, at least a portion of the refrigerant flowing through the second refrigerant circuit circulates through the third-b refrigerant circuit.

The refrigeration cycle further includes a first cooling chamber in which the first evaporator is disposed; and a second cooling chamber in which the second evaporator and the third evaporator are disposed, wherein temperature of the second cooling chamber is lower than temperature of the first cooling chamber.

Which is operated in a whole cooling mode and a freezing/cooling mode, wherein the refrigerant flows through the first refrigerant circuit and the third refrigerant circuit in the whole cooling mode, and the refrigerant flows through the second refrigerant circuit and the third refrigerant circuit in the freezing/cooling mode, and wherein, when the refrigeration cycle is operated in the whole cooling mode, the first cooling chamber and the second cooling chamber are cooled, and when the refrigeration cycle is operated in the freezing/cooling mode, the second cooling chamber is cooled.

The second cooling chamber comprises a forced draft fan configured to cause air to flow through the second cooling chamber, wherein the third evaporator is provided at a downstream end of the second evaporator in a direction in which the air flows through the second cooling chamber by the forced draft fan.

The refrigerant ejected from the condenser includes a main refrigerant flowing into the ejector via the first refrigerant circuit or the second refrigerant circuit; and a sub-refrigerant branching at the junction, flowing through the third refrigerant circuit, and meeting the main refrigerant at the ejector.

The refrigeration cycle further includes a first channel switch device configured to cause the refrigerant ejected from the ejector to flow through at least one of the first refrigerant circuit and the second refrigerant circuit; and a second channel switch device configured to cause the refrigerant branching at the junction to the third refrigerant circuit to flow through a third-a refrigerant circuit or a third-b refrigerant circuit.

The ejector mixes the refrigerant ejected from the condenser and the refrigerant ejected from the third evaporator, increases pressure of a result of mixing the refrigerants, and causes the result of mixing the refrigerants to flow into the compressor.

The ejector includes a nozzle part configured to reduce pressure of the refrigerant ejected from the condenser and expands the refrigerant; a sucking part configured to suck the refrigerant ejected from the third evaporator; a mixing part configured to mix the refrigerant flowing into the nozzle part and the refrigerant flowing into the sucking part; and a diffuser part configured to increase a pressure of a result of mixing the refrigerants in the mixing part.

The nozzle part includes a nozzle body; a nozzle entrance through which the refrigerant flows into the nozzle body; and a nozzle ejecting part configured to eject the refrigerant from the nozzle body, the nozzle ejecting part having a width greater than a width of the nozzle entrance, and the ejector further comprises a needle unit having a cross section varying in a lengthwise direction of the ejector, and configured to be moved forward to the nozzle entrance or backward from the nozzle entrance.

The refrigeration cycle further includes a first heat exchanger configured to exchange heat between the first expansion device and a sucking part of the compressor so as to overheat the refrigerant sucked into the compressor.

The refrigeration cycle further includes a second heat exchanger configured to exchange heat between the sucking part of the compressor and an ejecting part of the condenser.

The refrigeration cycle further includes a second heat exchanger configured to exchange heat between the sucking part of the compressor and a downstream end of the junction in the first refrigerant circuit or second refrigerant circuit.

The refrigeration cycle further includes a first heat exchanger configured to exchange heat among the first expansion device, the second expansion device, and a sucking part of the compressor so as to overheat the refrigerant sucked into the compressor.

The refrigeration cycle further includes a second heat exchanger configured to exchange heat between the sucking part of the compressor and an ejecting part of the condenser.

The refrigeration cycle further includes a second heat exchanger configured to exchange heat between the sucking part of the compressor and a downstream end of the junction in the first refrigerant circuit or the second refrigerant circuit.

The refrigeration cycle further includes a third expansion device provided at an ejecting part of the condenser; and a first heat exchanger configured to exchange heat between the third expansion device and a sucking part of the compressor.

The refrigeration cycle further includes a first heat exchanger configured to exchange heat between a sucking part of the compressor and a downstream end of the junction in the first refrigerant circuit or the second refrigerant circuit.

The expansion device comprises a capillary tube and an electronic expansion valve.

In accordance with a first aspect of the present invention, a refrigeration cycle includes a compressor; a condenser configured to condense a refrigerant ejected from the compressor; an ejector into which a main refrigerant which is at least a portion of the refrigerant ejected from the condenser flows; a main evaporator into which the refrigerant ejected from the ejector flows and which ejects the refrigerant to the compressor by exchanging heat with the surroundings, the main evaporator including a first evaporator and a second evaporator, wherein the first evaporator is disposed in a first cooling chamber, and a second evaporator is disposed in a second cooling chamber which is colder than the first cooling chamber; an expansion device to which a sub-refrigerant which is a remaining portion of the refrigerant ejected from the condenser is moved; a sub-evaporator including a third evaporator disposed in the second cooling chamber, and configured to cause the sub-refrigerant flowing through the expansion device to pass therethrough by exchanging heat with the surrounding, and eject the sub-refrigerant to the ejector; and a first channel switch device configured to cause the refrigerant ejected from the ejector to pass through at least one of the first evaporator and the second evaporator.

The expansion device includes a first expansion device; and a second expansion device disposed in series with the first expansion device, and the refrigeration cycle further comprises a second channel switch device provided at an upstream end of the expansion device, and configured to cause the refrigerant to pass through either the first expansion device or the first expansion device and the second expansion device.

The first channel switch device is provided to cause the refrigerant ejected from the ejector to flow through either the first evaporator or the second evaporator.

The ejector mixes the main refrigerant ejected from the condenser and the sub-refrigerant ejected from the sub-evaporator, increases a pressure of a result of mixing the main refrigerant and the sub-refrigerant, and transmits the result of mixing the main refrigerant and the sub-refrigerant to the compressor.

In accordance with a first aspect of the present invention, a refrigerator includes a main body; a first cooling chamber included in the main body, and a second cooling chamber provided to be colder than the first cooling chamber; and a refrigeration cycle including a first evaporator and a second evaporator included in the first cooling chamber, and a third evaporator included in the second cooling chamber, and configured to cool the first cooling chamber and the second cooling chamber, wherein the refrigeration cycle further comprises: a first refrigerant circuit configured to cause a refrigerant ejected from a compressor to flow through a condenser, an ejector, the first evaporator, and the second evaporator and then flow back to the compressor, a second refrigerant circuit configured to cause the refrigerant to bypass the first evaporator in the first refrigerant circuit; and a third refrigerant circuit branching at a junction provided at a downstream end of the condenser from the first refrigerant circuit or the second refrigerant circuit, and configured to cause the refrigerant to flow through an expansion device and the third evaporator, and flow to the ejector.

The refrigeration cycle includes a whole cooling mode in which the refrigerant flows through the first refrigerant circuit and the third refrigerant circuit; and a freezing/cooling mode in which the refrigerant flows through the second refrigerant circuit and the third refrigerant circuit.

The expansion device includes a first expansion device; and a second expansion device disposed in series with the first expansion device, and the third refrigerant circuit comprises: a third-a refrigerant circuit configured to cause the refrigerant to flow through the first expansion device provided at an upstream end of the third evaporator; and a third-b refrigerant circuit configured to cause the refrigerant to flow through the first expansion device and the second expansion device.

The ejector is arranged closer to the direction of gravity than the third evaporator.

Advantageous Effects

According to one aspect of the present invention, a coefficient of performance (COP) of a refrigeration cycle may be improved.

Furthermore, an ejector may be used to improve energy efficiency.

In addition, a plurality of cooling chambers may be separately cooled to improve cooling efficiency.

DESCRIPTION OF DRAWINGS

FIG. 1 illustrates a~

FIG. 1 is a diagram illustrating a refrigeration cycle in accordance with a first embodiment of the present invention.

FIGS. 2A and 2B are diagrams illustrating a flow of a refrigerant in the refrigeration cycle in accordance with the first embodiment of the present invention.

FIG. 3 is a diagram illustrating an ejector of the refrigeration cycle in accordance with the first embodiment of the present invention.

FIG. 4 is a diagram illustrating operations of some elements of the refrigeration cycle according to an operating mode, in accordance with the first embodiment of the present invention.

FIG. 5 is a control diagram of the refrigeration cycle in accordance with the first embodiment of the present invention.

FIGS. 6A and 6B are diagrams illustrating arrangement of a refrigerator and the refrigeration cycle in accordance with the first embodiment of the present invention.

FIG. 7 is a diagram illustrating a refrigeration cycle in accordance with the second embodiment of the present invention.

FIGS. 8A and 8B are diagrams illustrating a flow of a refrigerant in the refrigeration cycle in accordance with the second embodiment of the present invention.

FIG. 9 is a diagram illustrating a refrigeration cycle in accordance with the third embodiment of the present invention.

FIGS. 10A and 10B are diagrams illustrating a flow of a refrigerant in the refrigeration cycle in accordance with the third embodiment of the present invention.

FIG. 11 is a diagram illustrating a refrigeration cycle in accordance with the fourth embodiment of the present invention.

FIGS. 12A and 12B are diagrams illustrating a flow of a refrigerant in the refrigeration cycle in accordance with the fourth embodiment of the present invention.

FIG. 13 is a diagram illustrating a refrigeration cycle in accordance with the fifth embodiment of the present invention.

FIGS. 14A and 14B are diagrams illustrating a flow of a refrigerant in the refrigeration cycle in accordance with the fifth embodiment of the present invention refrigeration cycle.

FIG. 15 is a diagram illustrating a refrigeration cycle in accordance with the sixth embodiment of the present invention.

FIGS. 16A and 16B are diagrams illustrating a flow of a refrigerant in the refrigeration cycle in accordance with the sixth embodiment of the present invention.

FIG. 17 is a diagram illustrating a refrigeration cycle in accordance with the seventh embodiment of the present invention.

FIGS. 18A and 18B are diagrams illustrating a flow of a refrigerant in the refrigeration cycle in accordance with the seventh embodiment of the present invention.

FIG. 19 is a diagram illustrating a refrigeration cycle in accordance with the eighth embodiment of the present invention.

FIGS. 20A and 20B are diagrams illustrating a flow of a refrigerant in the refrigeration cycle in accordance with the eighth embodiment of the present invention.

FIG. 21 is a diagram illustrating a refrigeration cycle in accordance with the ninth embodiment of the present invention.

FIGS. 22A and 22B are diagrams illustrating a flow of a refrigerant in the refrigeration cycle in accordance with the ninth embodiment of the present invention.

FIG. 23 is a diagram illustrating a refrigeration cycle in accordance with the tenth embodiment of the present invention.

FIG. 24 is a diagram illustrating a flow of a refrigerant in the refrigeration cycle in accordance with the tenth embodiment of the present invention.

MODES OF THE INVENTION

Hereinafter, exemplary embodiments of the present invention will be described in detail with reference to the accompanying drawings.

FIG. 1 is a diagram illustrating a refrigeration cycle in accordance with a first embodiment of the present invention.

As illustrated in FIG. 1, a compressor 110, a condenser 120, at least one evaporator 130, an ejector 180, and a channel switch device 190 are connected to one another via a refrigerant pipe, thereby forming a closed-loop refrigerant circuit.

In detail, a refrigeration cycle 100 includes a first refrigerant circuit, a second refrigerant circuit, and a third refrigerant circuit.

The first refrigerant circuit is configured to cause a refrigerant ejected from the compressor 110 to flow through the condenser 120, the ejector 180, a first evaporator 140, and a second evaporator 150 and flow back to the compressor 110. The second refrigerant circuit is configured to cause the refrigerant to bypass the first evaporator 140 in the first refrigerant circuit. That is, the refrigerant may pass through the first evaporator 140 and the second evaporator 150 in the first refrigerant circuit, and pass through only the second evaporator 150 in the second refrigerant circuit. The third refrigerant circuit branches at a junction S at a downstream end of the condenser 120 from the first or second refrigerant circuit, and is configured to cause the refrigerant to pass through an expansion device 170 and a third evaporator 160 and then flow to the ejector 180. The refrigerant may flow through either the first refrigerant circuit or the second refrigerant circuit, and the third refrigerant circuit.

The third refrigerant circuit includes a third-a refrigerant circuit and a third-b refrigerant circuit. The expansion device 170 lowers a temperature and pressure of a refrigerant which is in a liquid state. The expansion device 170 includes a first expansion device 171 provided at an upstream end of the third evaporator 160, and a second expansion device 172 arranged in series with the first expansion device 171. The third-a refrigerant circuit is provided to cause the refrigerant to pass through the first expansion device 171 provided at the upstream end of the third evaporator 160. The third-b refrigerant circuit is provided to cause the refrigerant to pass through the first expansion device 171 and the second expansion device 172.

Purposes of the first evaporator 140, the second evaporator 150, and the third evaporator 160 are not limited, but the first evaporator 140 may be used in a refrigeration chamber of a refrigerator 80 and the second evaporator 150 and the third evaporator 160 may be used in a freezer of the refrigerator 80 in an embodiment of the present invention. That is, the first evaporator 140 may be interchangeably referred to a refrigeration chamber evaporator 130, and the second evaporator 150 and the third evaporator 160 may be interchangeably referred to as freezer evaporators 130. The refrigeration chamber of the refrigerator 80 may be interchangeably referred to as a first cooling chamber 91. The freezer of the refrigerator 80 may be interchangeably referred to as a second cooling chamber 92. A temperature of the second cooling chamber 92 may be lower than that of the first cooling chamber 91.

The refrigeration cycle 100 may be operated in a whole cooling mode and a freezing/cooling mode.

The whole cooling mode is an operating mode in which both the first cooling chamber 91 and the second cooling chamber 92 are cooled. That is, in the whole cooling mode, a refrigerant may flow through the first evaporator 140, the second evaporator 150, and the third evaporator 160. In the whole cooling mode, the refrigerant may flow through the first refrigerant circuit and the third refrigerant circuit. In detail, in the whole cooling mode, the refrigerant may flow through the first refrigerant circuit and the third-a refrigerant circuit.

The freezing/cooling mode is an operating mode in which the second cooling chamber 92 is cooled. That is, in the freezing/cooling mode, a refrigerant may flow through the second evaporator 150 and the third evaporator 160. In the freezing/cooling mode, the refrigerant may flow through the second refrigerant circuit and the third refrigerant circuit. In detail, in the freezing/cooling mode, the refrigerant may flow through the second refrigerant circuit and the third-b refrigerant circuit.

The whole cooling mode and the freezing/cooling mode are different in terms of the number of evaporators 130 through which the refrigerant flows. Thus, a flow rate of the refrigerant need be adjusted. To this end, the compressor 110 may include an inverter compressor. The flow rate of the refrigerant flowing through a refrigerant circuit may be adjusted through control of an RPM of the inverter compressor and thus each of the whole cooling mode and the freezing/cooling mode may be switched to the other.

A flow of a refrigerant between a plurality of refrigerant circuits may be controlled by the channel switch device 190. The channel switch device 190 is provided to switch the flow of the refrigerant in the first refrigerant circuit, the second refrigerant circuit, the third-a refrigerant circuit, and the third-b refrigerant circuit according to required temperatures of the first cooling chamber 91 and the second cooling chamber 92.

The channel switch device 190 includes a first channel switch device 191 and a second channel switch device 192.

The first channel switch device 191 controls the flow of the refrigerant between the first refrigerant circuit and the second refrigerant circuit. In detail, the first channel switch device 191 is provided to cause a refrigerant ejected from the ejector 180 to flow through at least one of the first refrigerant circuit and the second refrigerant circuit.

In detail, the first channel switch device 191 is provided to move the refrigerant to either the first refrigerant circuit in which a refrigerant flows through the first evaporator 140 and the second evaporator 150 or the second refrigerant circuit in which a refrigerant flows through the second evaporator 150.

The second channel switch device 192 is provided at the downstream end of the condenser 120 and between the junction S branching from the first refrigerant circuit or the second refrigerant circuit to the third refrigerant circuit and the expansion device 170. The second channel switch device 192 controls the flow of the refrigerant between the third-a refrigerant circuit and the third-b refrigerant circuit. In detail, the second channel switch device 192 is provided to cause the refrigerant branching at the junction S to flow through at least one of the third-a refrigerant circuit and the third-b refrigerant circuit.

In detail, the second channel switch device 192 is provided to move the refrigerant to either the third-a refrigerant circuit causing the refrigerant to flow through the first expansion device 171 or the third-b refrigerant circuit causing the refrigerant to flow through the first expansion device 171 and the second expansion device 172.

The channel switch device 190 may include a 3-way valve. The first channel switch device 191 may include a first-a valve 191*a* for opening or closing the first refrigerant circuit and a first-b valve 191*b* for opening or closing the second refrigerant circuit. The second channel switch device 192 may include a second-a valve 192*a* for opening or closing the third-a refrigerant circuit and a second-b valve 192*b* for opening or closing the third-b refrigerant circuit.

The refrigeration cycle 100 includes the condenser 120, a plurality of forced draft fans 121, 141, and 151 adjacent to the cooling chambers 91 and 92, and a plurality of fan motors 122, 142, and 152 for driving the forced draft fans 121, 141, and 151. In detail, the refrigeration cycle 100 includes the condenser-forced draft fan 121, the first cooling chamber-forced draft fan 141, and the second cooling chamber-forced draft fan 151, and the condenser fan motor 122, the first cooling-chamber fan motor 142, and the second cooling-chamber fan motor 152 for driving the condenser-forced draft fan 121, the first cooling chamber-forced draft fan 141, and the second cooling chamber-forced draft fan 151.

Furthermore, a first defrosting heater 143 and a second defrosting heater 153 may be respectively provided on a surface of the first evaporator 140 and a surface of the second evaporator 150 to remove frost on a surface of the at least one evaporator 130.

Examples of a working refrigerant flowing through the refrigeration cycle 100 may include HC-based isobutane (R600a), propane (R290), HFC-based R134a, and HFO-based R1234yf. However, the type of a refrigerant is not limited thereto and any refrigerant which may reach a target temperature through exchange of heat with the surroundings may be employed.

The expansion device 170 may include a capillary tube, an electronic expansion valve (EV).

FIGS. 2A and 2B are diagrams illustrating a flow of a refrigerant in the refrigeration cycle in accordance with the first embodiment of the present invention. FIG. 3 is a diagram illustrating an ejector of the refrigeration cycle in accordance with the first embodiment of the present invention. FIG. 2A illustrates the flow of the refrigerant in the whole cooling mode. FIG. 2B illustrates the flow of the refrigerant in the freezing/cooling mode.

The ejector 180 is provided to perform isentropic expansion in a cooling apparatus.

The ejector 180 may include a nozzle part 181, a sucking part 183, a mixing part 184, and a diffuser part 185. A refrigerant ejected from the compressor 110 flows to the junction S via the condenser 120. The refrigerant arriving at the junction S is divided into a main refrigerant flowing from the junction S to the ejector 180 and a sub-refrigerant moving along the third refrigerant circuit.

The main refrigerant flows through the nozzle part 181 and then flows to the mixing part 184. The sub-refrigerant flows along the third refrigerant circuit, is sucked into the sucking part 183 of the ejector 180, is mixed with the main refrigerant in the mixing part 184, and is then ejected from the ejector 180 via the diffuser part 185.

Based on the flow of the main refrigerant and the sub-refrigerant, the at least one evaporator 130 may be classified as main evaporators and a sub-evaporator. The main evaporators include the first evaporator 140 included in the first cooling chamber 91 and the second evaporator 150 included in the second cooling chamber 92. The sub-evaporator includes the third evaporator 160 included in the second cooling chamber 92.

When passing through the nozzle part 181, the main refrigerant isentropically expands and an enthalpy difference between front and rear parts of the nozzle part 181 is equal to the difference between speeds of the main refrigerant. Thus, the main refrigerant may be ejected at a high speed from an exit of the nozzle part 181.

In the diffuser part 185, the energy of speed of a mixture of the main refrigerant and the sub-refrigerant is converted into the energy of pressure, thereby obtaining the effect of increasing pressure. When the refrigerant passing through the ejector 180 flows into the compressor 110 through the above process, a compression work of the compressor 110 is decreased and thus a coefficient of performance (COP) of the refrigeration cycle 100 increases.

The flow of the refrigerant in the ejector 180 will be described below.

The main refrigerant ejected from the condenser 120 flows into an entrance of the nozzle part 181 of the ejector 180. As the main refrigerant passes through the nozzle part 181 of the ejector 180, the flow velocity of the main refrigerant increases and the pressure thereof decreases.

The nozzle part 181 includes a nozzle body 181*a*, a nozzle entrance 181*b* through which the main refrigerant flows into the nozzle body 181*a*, and a nozzle ejecting part 181*c* from which the main refrigerant is ejected.

The main refrigerant flows through the nozzle ejecting part 181*c* in a state in which the pressure of the main refrigerant decreases. The sub-refrigerant flowing in a saturated gas state through the second evaporator 150 via the second refrigerant circuit or the third refrigerant circuit is sucked into the sucking part 183 of the ejector 180 due to the difference between the pressure of the sub-refrigerant and the pressure of the main refrigerant which is lower than a saturated pressure.

The main refrigerant passing through the nozzle part 181 and the sub-refrigerant sucked into the sucking part 183 are mixed in the mixing part 184 of the ejector 180. The flow velocity of a mixture of the main refrigerant and the sub-refrigerant decreases and the pressure thereof increases as the mixture flows through the diffuser part 185 having a fan shape and formed at an exit part of the ejector 180. Thus, the mixture flows into the first evaporator 140 or the second evaporator 150. While passing through the at least one evaporator 130, the mixture absorbs heat from the surroundings and thus evaporates. Thus, the mixture is converted into a saturated gas or a supersaturated state at an exit of the at least one evaporator 130 and is then sucked into the compressor 110.

As described above, a pressure of a refrigerant sucked into the compressor 110 in the refrigeration cycle 100 having the ejector 180 is higher than that in a refrigeration cycle which does not have the ejector 180. Thus, when the refrigerant flowing into the compressor 110 is compressed to a condensing temperature, a work ratio of the compressor 110 decreases and the COP of a whole cycle increases.

The ejector 180 may include a needle unit 187.

The needle unit 187 may include a needle part 187*a* and a needle driving part 187*b*. A diameter of a cross section of the needle part 187*a* changes in a lengthwise direction thereof. One end of the needle part 187*a* passes through the nozzle entrance 181*b*. Due to the above structure, a width of the nozzle entrance 181*b* through which the refrigerant flows into the nozzle body 181*a* may be finely adjusted by moving the needle part 187*a* forward to or backward from the nozzle body 181*a* via the nozzle entrance 181*b*.

The needle driving part 187*b* may be provided at one end of the needle unit 187 so that the needle unit 187 may be moved forward or backward.

The main refrigerant and the sub-refrigerant are mixed together as they flow through the ejector 180. A ratio of a mass flow rate of the sub-refrigerant to a mass flow rate of the main refrigerant is referred to as an entrainment ratio ω.

An increase in the pressure of the ejector 180 is one of factors which improve the performance of the refrigeration cycle 100. A pressure list ratio (PLR) representing an increase in the pressure is defined as an index representing the performance of the ejector 180, as follows:

$$PLR=(P5-P6)/P6*100[\%]$$

The PLR of the ejector 180 is inversely proportional to the entrainment ratio. In order to increase the PLR to improve the COP of the refrigeration cycle 100, an amount of sucking should be decreased. However, a dryness value of the refrigerant passing through the ejector 180 is not easily arbitrarily changed. Even if the amount of sucking is decreased by maintaining a low dryness value, the cooling capability of the at least one evaporator 130 may decrease and thus makes it difficult to improve an ultimate COP.

Thus, even when the cooling capability of the third evaporator 160 is low, the cooling capability of the second evaporator 150 may be supplemented by arranging the first evaporator 140 and the second evaporator 150 in the first refrigerant circuit and the second refrigerant circuit and arranging the second evaporator 150 and the third evaporator 160 in the second cooling chamber 92 to decrease the amount of sucking so as to improve the PLR of the ejector 180, thereby improving the COP of the refrigeration cycle 100.

The whole cooling mode in which both the refrigeration chamber, i.e., the first cooling chamber 91, and the freezer, i.e., the second cooling chamber 92, are cooled, and the freezing/cooling mode in which only the second cooling chamber 92 is cooled may be classified according to a driving condition determined by a direction of a channel of the channel switch device 190.

First, a flow of the refrigeration cycle 100 in the whole cooling mode will be described with reference to the Mollier chart.

The compressor 110 sucks low-temperature and low-pressure vapor of a refrigerant and compresses it into high-temperature and high-pressure superheated vapor (8→1). As the high-temperature and high-pressure superheated vapor exchanges heat with ambient air and radiates heat as it passes through the condenser 120, the refrigerant is condensed into a liquid refrigerant or a 2-phase refrigerant (1→2).

The refrigerant condensed by the condenser 120 branches into a main refrigerant and a sub-refrigerant at the junction S.

The main refrigerant flows into the nozzle entrance 181*b* of the ejector 180. A pressure of the main refrigerant flowing into the nozzle entrance 181*b* is decreased through an isentropic process as it flows through the nozzle part 181 of the ejector 180. Thus, a phase change occurs to convert the refrigerant into a 2-phase refrigerant (2→3). At the nozzle ejecting part 181*c*, the main refrigerant is in a high-speed and low-pressure state.

The ejector 180 includes a sucking channel part 182 disposed in a concentric form with the nozzle ejecting part 181*c*. As the main refrigerant is in the high-speed and low-pressure state, a pressure of the sub-refrigerant is changed to a low pressure substantially the same as that of the main refrigerant, as the sub-refrigerant passes through the nozzle ejecting part 181*c* and the sucking channel part 182 lying on the same line as the flow of the refrigerant and having a concentric form. The sub-refrigerant branching from the refrigerant at the junction S flows into the second channel switch device 192. In the whole cooling mode, as the second-a valve 192*a* is opened and the second-b valve 192*b* is closed in the second channel switch device 192, the sub-refrigerant passing through the second channel switch device 192 (2=9) passes through the first expansion device 171 (9→10) and the third evaporator 160 (10→6). In this case, a temperature at which the third evaporator 160 is cooled may be about −19° C.

The sub-refrigerant passing through the third evaporator 160 is sucked into the sucking part 183 of the ejector 180 in a low-pressure saturated vapor state. In this case, a force of sucking the refrigerant corresponds to the difference between a saturated pressure of the third evaporator 160 and a pressure of the sucking channel part 182 which is the same as that of the nozzle ejecting part 181*c*. In general, a pressure of the nozzle ejecting part 181*c* is lower than that of the sucking part 183 and thus the sub-refrigerant is sucked into the flow of the main refrigerant (6→3').

In the mixing part 184, the main refrigerant flowing through the nozzle part 181 and the sub-refrigerant sucked into the sucking part 183 and flowing through the sucking channel part 182 are mixed together and thus the quantity of motion is transferred (3→4 and 3'→4), and a pressure of the refrigerant is increased by a predetermined level as the flow velocity of the refrigerant is decreased through the diffuser part 185 (4→5').

The refrigerant of the increased pressure flows into the first channel switch device 191. In the whole cooling mode, as the first-a valve 191*a* is opened and the first-b valve 191*b* is closed in the first channel switch device 191, the refrigerant passes through the first evaporator 140 (5→7) and then passes through the second evaporator 150 (7→8).

The refrigerant which is in a low-temperature and low-pressure state and which flows through the second evaporator 150 is sucked into the compressor 110, and compressed into high-pressure and high-temperature superheated vapor (8→1), Next, a flow of the refrigeration cycle 100 in the freezing/cooling mode will be described with reference to the Mollier chart.

The compressor 110 sucks low-temperature and low-pressure vapor of a refrigerant and compresses it into high-temperature and high-pressure superheated vapor (8→1). As the high-temperature and high-pressure superheated vapor exchanges heat with ambient air and radiates heat as it passes through the condenser 120, the refrigerant is condensed into a liquid refrigerant or a 2-phase refrigerant (1→2).

The refrigerant condensed by the condenser 120 branches into a main refrigerant and a sub-refrigerant at the junction S.

The main refrigerant flows into the nozzle entrance 181*b* of the ejector 180. A pressure of the main refrigerant flowing into the nozzle entrance 181*b* is lowered through the isentropic process as the main refrigerant passes through the nozzle part 181 of the ejector 180 and thus a phase change occurs to convert the refrigerant into a 2-phase refrigerant (2→3). At the nozzle ejecting part 181*c*, the main refrigerant is in a high-speed and low-pressure state.

A pressure of the sucking channel part 182 lying on a cross section on the same line as the nozzle ejecting part 181*c* and having a concentric form is low. The sub-refrigerant branching from the refrigerant at the junction S flows into the second channel switch device 192. In the freezing/cooling mode, as the second-a valve 192*a* is closed and the second-b valve 192*b* is opened in the second channel switch device 192, the sub-refrigerant passing through the second channel switch device 192 flows through the second expansion device 172 (2→9).

The sub-refrigerant passing through the second expansion device 172 flows through the first expansion device 171 (9→10) and then the third evaporator 160 (10→6). In this case, a temperature at which the third evaporator 160 is cooled may be about −28° C. which is lower than that in the whole cooling mode, as pressure is additionally reduced at the second expansion device 172. In addition, the nozzle entrance 181*b* is controlled by the needle unit 187 and thus pressure is reduced to a larger level than in the whole cooling mode.

The sub-refrigerant passing through the third evaporator 160 is in a low-pressure saturated vapor state and is sucked into the sucking part 183 of the ejector 180. In this case, a force of sucking the refrigerant corresponds to the difference between a saturated pressure of the third evaporator 160 and a pressure of the sucking channel part 182 which is the same as that of the nozzle ejecting part 181*c*. In general, a pressure of the nozzle ejecting part 181*c* is lower than that of the sucking part 183 and thus the sub-refrigerant is sucked into the flow of the main refrigerant (6→3').

In the mixing part 184, the main refrigerant passing through the nozzle part 181 and the sub-refrigerant sucked into the sucking part 183 and passing through the sucking channel part 182 are mixed together and thus the quantity of motion is transferred (3→4 and 3'→4). The flow velocity of the refrigerant is decreased through the diffuser part 185 and thus the pressure of the refrigerant is increased by a certain level (4→5').

The refrigerant of the increased pressure flows into the first channel switch device 191. In the freezing/cooling mode, as the first-a valve 191*a* is closed and the first-b valve 191*b* is opened in the first channel switch device 191, the refrigerant passes through the first channel switch device 191 (5=7) and then the second evaporator 150 (7→8).

The refrigerant of the low-temperature and low-pressure passing through the second evaporator 150 is sucked into the compressor 110 and is then compressed into high-temperature and high-pressure superheated vapor (8→1).

FIG. 4 is a diagram illustrating operations of some elements of the refrigeration cycle according to an operating mode, in accordance with the first embodiment of the present invention.

The whole cooling mode and the freezing/cooling mode will be described and then a defrosting mode will be described with reference to FIG. 4 below.

ON/OFF states of the compressor 110, the first cooling chamber-forced draft fan 141, and the second cooling chamber-forced draft fan 151, and opening/closing states of the first-a valve 191*a* and the second-a valve 192*a* configured, when opened, to cause a refrigerant to flow to the first refrigerant circuit and the third-a refrigerant circuit and the first-b valve 191*b* and the second-b valve 192*b* configured, when opened, to cause a refrigerant to flow to the second refrigerant circuit and the third-b refrigerant circuit will be described with reference to FIG. 4 below.

In the whole cooling mode, when the compressor 110 is started up, the first cooling chamber-forced draft fan 141 and the second cooling chamber-forced draft fan 151 are also operated, the first-a valve 191*a* and the second-a valve 192*a* are opened, and the first-b valve 191*b* and the second-b valve 192*b* are closed.

Since the refrigerant flows through the first refrigerant circuit, the refrigerant flows from the first evaporator 140 to the second evaporator 150 via the first channel switch device 191. When the first cooling chamber 91 reaches a target temperature by the first evaporator 140 earlier than the second cooling chamber 92, the freezing/cooling mode is operated. The target temperature of the first cooling chamber 91 is not limited but is preferably a temperature above zero, for example, 3° C. In this case, a temperature of the second cooling chamber 92 is not limited but is preferably a temperature below zero, for example, −18° C.

In the freezing/cooling mode, the first cooling chamber-forced draft fan 141 is stopped, the first-a valve 191*a* and the second-a valve 192*a* are closed, and the first-b valve 191*b* and the second-b valve 192*b* are opened. In the freezing/cooling mode, only the second cooling chamber 92 is cooled, and the refrigerant flows only through the second refrigerant circuit and thus flows to the second evaporator 150 via the first channel switch device 191.

Since the number of evaporators 130 operated in the whole cooling mode is different than that in the freezing/cooling mode, a flow rate of the refrigerant needed in the whole cooling mode and a flow rate of the refrigerant needed in the freezing/cooling mode are different from each other. Thus, when the whole cooling mode is switched to the freezing/cooling mode, a capability variable inverter compressor may be employed to control an RPM thereof, thereby controlling the flow rate of the refrigerant.

When the second cooling chamber 92 reaches the target temperature, the defrosting mode may be entered.

A target temperature of the second cooling chamber 92 in the freezing/cooling mode is not limited but is preferably a temperature below zero, for example, −28° C., which is lower than that of the second cooling chamber 92 in the whole cooling mode.

In the defrosting mode, the compressor 110 and the second cooling chamber-forced draft fan 151 may be stopped and only the first cooling chamber-forced draft fan 141 may be operated. Furthermore, the first-a valve 191*a* and the second-a valve 192*a* may be opened and the first-b valve 191*b* and the second-b valve 192*b* may be closed. That is, the channel switch device 190 opens the first-a valve 191*a* and the second-a valve 192*a* to cause the refrigerant to flow through the first refrigerant circuit and the third-a refrigerant circuit. Due to the above structure, frost formed on the first evaporator 140 may be removed by circulating air through the first cooling chamber 91. Moisture generated in the defrosting mode may increase the humidity in the refrigerator 80. Furthermore, vegetables may be kept fresh inside the refrigerator 80 owing to the moisture generated in the defrosting mode.

FIG. 5 is a control diagram of the refrigeration cycle in accordance with the first embodiment of the present invention.

The refrigerator 80 in accordance with an embodiment of the present invention may provide various refrigeration modes under control of a controller 60 such as a microcomputer. FIG. 5 is a control block diagram in accordance with an embodiment of the present invention, explained with respect to the controller 60 included in the refrigerator 80. As shown in FIG. 5, a key input unit 52, a first cooling chamber temperature sensor 54, and a second cooling chamber temperature sensor 56 are connected to an input port of the controller 60. The key input unit 52 includes a plurality of function keys. The function keys include function keys related to setting a condition of driving the refrigerator 80, such as setting of a cooling mode or setting of a desired temperature. The first cooling chamber temperature sensor 54 and the second cooling chamber temperature sensor 56 respectively sense internal temperatures of the first cooling chamber 91 and the second cooling chamber 92 and provide them to the controller 60.

A compressor driving unit 62, a first cooling chamber-forced draft fan driving unit 64, a second cooling chamber-forced draft fan driving unit 66, a channel switch device driving unit 68, a defrosting-heater driving unit 72, and a display unit 70 are connected to an output port of the controller 60. The elements except the display unit 70 respectively drive the compressor 110, the first cooling-chamber fan motor 142, the second cooling-chamber fan motor 152, the first-a valve 191*a* and the first-b valve 191*b* of the first channel switch device 191, the second-a valve 192*a* and the second-b valve 192*b* of the second channel switch device 192, and the defrosting heaters 143 and 153. The display unit 70 displays an operating state, various setting values, a temperature, etc. of a cooling apparatus.

The controller 60 may implement various cooling modes by controlling the first channel switch device 191 and the second channel switch device 192 to circulate a refrigerant through one of the first refrigerant circuit and the second refrigerant circuit and one of the third-a refrigerant circuit and the third-b refrigerant circuit illustrated in FIG. 5. Representative examples of a cooling mode which may be implemented by the refrigerator 80 in accordance with an embodiment of the present invention may include a whole cooling mode which is a first cooling mode and a freezing/cooling mode which is a second cooling mode. In the whole cooling mode, both the first cooling chamber 91 and the second cooling chamber 92 are cooled. For the whole cooling mode, the controller 60 may open the first-a valve 191*a* of the first channel switch device 191 and the second-a valve 192*a* of the second channel switch device 192. In the whole cooling mode, a refrigerant ejected from the condenser 120 flows through the first evaporator 140, the second evaporator 150, the third evaporator 160, and the first expansion device 171.

The freezing/cooling mode is an operating mode in which only the second cooling chamber 92 is cooled. In the freezing/cooling mode, the controller 60 opens the first-b valve 191*b* of the first channel switch device 191 and the second-b valve 192*b* of the second channel switch device 192. In the freezing/cooling mode, a refrigerant ejected from the condenser 120 flows through the second evaporator 150, the third evaporator 160, the first expansion device 171, and the second expansion device 172.

Due to the above structure, in order to cool the first cooling chamber 91 and the second cooling chamber 92, the whole cooling mode may be operated at an initial stage and be then switched to the freezing/cooling mode in which only the second cooling chamber 92 is cooled when a temperature of the first cooling chamber 91 reaches a predetermined temperature, thereby maximizing cooling efficiency. Furthermore, a refrigerant having a pressure increased by the ejector 180 may be sucked into the compressor 110, thereby decreasing a compression work. In addition, a flow rate of the refrigerant used in the freezing/cooling mode is lower than that in the whole cooling mode. The RPM of the inverter compressor may be controlled using the difference between the flow rates of the refrigerants in the freezing/cooling mode and the whole cooling mode, thereby efficiently managing the system.

An example of a state in which the refrigeration cycle 100 is included in the refrigerator 80 will be described below.

FIGS. 6A and 6B are diagrams illustrating arrangement of a refrigerator and the refrigeration cycle in accordance with the first embodiment of the present invention.

The refrigerator 80 may include a main body 90 forming the exterior of the refrigerator 80, the first cooling chamber 91 and the second cooling chamber 92 included in the main body 90, and a machine room 93.

The main body 90 may be formed of a material having an insulating property to prevent exchange of heat between the exterior thereof and the cooling chambers 91 and 92 therein. That is, the main body 90 may include an insulating wall 90*a* formed of an insulating material. The first cooling chamber 91, the second cooling chamber 92, and the machine room 93 may be divided by the insulating wall 90*a*.

The compressor 110, the condenser 120, the condenser-forced draft fan 121, and the condenser fan motor 122 may be arranged in the machine room 93. Through this arrangement, noise may be prevented from leaking to the outside of the main body 90, and heat generated by the compressor 110 and the condenser 120 may be prevented from being transferred to the cooling chambers 91 and 92.

The first evaporator 140, the first cooling chamber-forced draft fan 141, and the first cooling-chamber fan motor 142 may be provided in the first cooling chamber 91. The second evaporator 150, the third evaporator 160, the second cooling chamber-forced draft fan 151, and the second cooling-chamber fan motor 152 may be provided in the second cooling chamber 92.

The third evaporator 160 may be located at a downstream end of the second evaporator 150 in a direction of the flow of air through the second cooling chamber-forced draft fan 151. Owing to the above arrangement, the efficiency of heat exchange of the third evaporator 160 having a temperature lower than that of the second evaporator 150 may be improved.

The ejector 180 may be located below the third evaporator 160. A sub-refrigerant ejected from the third evaporator 160 is sucked into the sucking part 183 of the ejector 180. A refrigerant may be controlled to smoothly flow by controlling the sub-refrigerant to flow in the direction of gravity.

The ejector 180 may be arranged on the insulating wall 90*a* to minimize thermal losses caused by a change in an internal state and temperature of the ejector 180. Owing to this arrangement, thermal losses may be minimized when the ejector 180 exchanges heat with the surroundings.

The first channel switch device 191 may be located adjacent to the exit of the ejector 180, and arranged on the insulating wall 90*a* together with the ejector 180. Furthermore, as illustrated in the drawing, the first channel switch device 191 may be arranged in the second cooling chamber 92. Owing to this arrangement, thermal losses occurring in a refrigerant flowing through the first channel switch device 191 may be prevented. However, the first channel switch device 191 is not limited thereto, and may be arranged in the first cooling chamber 91 or between the first cooling chamber 91 and the second cooling chamber 92.

A refrigeration cycle in accordance with a second embodiment of the present invention and a refrigerator including the same will be described below.

FIG. 7 is a diagram illustrating a refrigeration cycle in accordance with the second embodiment of the present invention. FIGS. 8A and 8B are diagrams illustrating a flow of a refrigerant in the refrigeration cycle in accordance with the second embodiment of the present invention. FIG. 8A illustrates the flow of the refrigerant in the whole cooling mode. FIG. 8B illustrates the flow of the refrigerant in the freezing/cooling mode.

Elements of the second embodiment which are the same as those of the first embodiment are not described in detail here.

A refrigeration cycle 200 includes a first refrigerant circuit, a second refrigerant circuit, and a third refrigerant circuit.

The first refrigerant circuit is configured to cause a refrigerant ejected from a compressor 210 to flow through a condenser 220, an ejector 280, a first evaporator 240, and a second evaporator 250 and then flow back to the compressor 210. The second refrigerant circuit is configured to cause the refrigerant to bypass the first evaporator 240 in the first refrigerant circuit. That is, the refrigerant flows through the first evaporator 240 and the second evaporator 250 in the first refrigerant circuit, and flows through only the second evaporator 250 in the second refrigerant circuit. The third refrigerant circuit branches at a junction S at a downstream end of the condenser 220 from the first refrigerant circuit or the second refrigerant circuit, and is configured to cause the refrigerant to flow through an expansion device 270 and a third evaporator 260, and then to the ejector 280. The refrigerant may flow through the first refrigerant circuit or the second refrigerant circuit, and the third refrigerant circuit.

The third refrigerant circuit includes a third-a refrigerant circuit and a third-b refrigerant circuit. The expansion device 270 includes a first expansion device 271 provided at an upstream end of the third evaporator 260, and a second expansion device 272 arranged in series with the first expansion device 271. The third-a refrigerant circuit is provided to cause the refrigerant to flow through the first expansion device 271 provided at the upstream end of the third evaporator 260. The third-b refrigerant circuit is provided to cause the refrigerant to flow through the first expansion device 271 and the second expansion device 272.

The first evaporator 240 may be arranged in a first cooling chamber 91, and the second evaporator 250 and the third evaporator 260 may be arranged in a second cooling chamber 92.

A channel switch device 290 includes a first channel switch device 291 and a second channel switch device 292. The first channel switch device 291 may include a first-a valve 291*a* for opening or closing the first refrigerant circuit, and a first-b valve 291*b* for opening or closing the second refrigerant circuit. The second channel switch device 292 may include a second-a valve 292*a* for opening or closing the third-a refrigerant circuit, and a second-b valve 292*b* for opening or closing the third-b refrigerant circuit.

The refrigeration cycle 200 includes a plurality of forced draft fans adjacent to the condenser 220 and the cooling chambers 91 and 92, and a plurality of fan motors for driving the forced draft fans. In detail, the refrigeration cycle 200 includes a condenser forced draft fan 221, a first cooling chamber-forced draft fan 241, and a second cooling chamber-forced draft fan 251, and a condenser fan motor 222, a first cooling-chamber fan motor 242, and a second cooling-chamber fan motor 252 for respectively driving the condenser forced draft fan 221, the first cooling chamber-forced draft fan 241, and the second cooling chamber-forced draft fan 251.

A first defrosting heater 243 and a second defrosting heater 253 may be respectively provided on a surface of the first evaporator 240 and a surface of the second evaporator 250 to remove frost on at least one evaporator 230.

The ejector 280 may include a nozzle part 281, a sucking part 283, a mixing part 284, and a diffuser part 285. The nozzle part 281 may include a nozzle body 281*a*, a nozzle entrance 281*b*, and a nozzle ejecting part 281*c*. The ejector 280 may further include a sucking channel part 282 disposed in a concentric form with the nozzle ejecting part 281*c*.

The refrigeration cycle 200 may include a heat exchanger.

The heat exchanger is configured to exchange heat between a section of the third refrigerant circuit and an entrance of the compressor 210. It is preferable that a saturated gas or a refrigerant which is in a supersaturated state flow into the compressor 210 but a refrigerant which is in a liquid state may flow into the compressor 210. The heat exchanger may be provided to exchange heat between an exit of the condenser 220 and the entrance of the compressor 210, so that a decrease in the performance of the compressor 210 or breaking of the compressor 210 caused when the refrigerant which is in the liquid state flows thereinto may be prevented.

The heat exchanger may include a first heat exchanger 295*a* including the first expansion device 271 in the third refrigerant circuit, and a second heat exchanger 295*b* provided at an entrance portion of the compressor 210, and may transfer heat from the first heat exchanger 295*a* to the second heat exchanger 295*b*, thereby overheating the refrigerant flowing into the compressor 210.

The first expansion device 271 and the heat exchanger may be integrated with each other. The heat exchanger includes a suction line heat exchanger (SLHX). A degree of overheating the refrigerant sucked into the compressor 210 may be secured through the SLHX and thus the compressor 210 may be prevented from being broken when a liquid refrigerant flows thereinto.

The above process will be described with reference to the Mollier chart below. A process in which the refrigerant flows through the first heat exchanger 295*a* and the first expansion device 271 (9→10) and a process in which the refrigerant flows through the second heat exchanger 295*b*, i.e., a process in which the refrigerant flows from an ejecting part of the second evaporator 250 to the compressor 210 (8"→8) are different from in the Mollier chart in the first embodiment.

That is, since heat from the first heat exchanger 295*a* is transferred to the second heat exchanger 295*b*, an enthalpy in a state 10 in which the refrigerant passes through the first heat exchanger 295*a* and the first expansion device 271 is lower than that in a state 10 of the first embodiment in which the refrigerant passes through the first expansion device 171. Information regarding a change of a decrease in the enthalpy caused by this state change is transferred as information regarding a change of an increase in an enthalpy of the refrigerant flowing into the compressor 210. In other words, an enthalpy in a state 8 in which the refrigerant passes through the second heat exchanger 295*b* is greater than that in a state of the first embodiment in which the refrigerant passes through the heat exchanger.

Through the above process, the cooling capability of the third evaporator 260 may be increased and a degree of overheating a refrigerant sucked into the compressor 210 may be secured, and thus breaking of the compressor 210 may be prevented and the reliability thereof may be improved.

A refrigeration cycle in accordance with a third embodiment of the present invention and a refrigerator including the same will be described below.

FIG. 9 is a diagram illustrating a refrigeration cycle in accordance with the third embodiment of the present invention. FIGS. 10A and 10B are diagrams illustrating a flow of a refrigerant in the refrigeration cycle in accordance with the third embodiment of the present invention. FIG. 10A illustrates the flow of the refrigerant in the whole cooling mode. FIG. 10B illustrates the flow of the refrigerant in the freezing/cooling mode.

Elements of the third embodiment which are the same as those of the first embodiment are not described in detail here.

A refrigeration cycle 300 includes a first refrigerant circuit, a second refrigerant circuit, and a third refrigerant circuit.

The first refrigerant circuit is configured to cause a refrigerant ejected from a compressor 310 to flow through a condenser 320, an ejector 380, a first evaporator 340, and a second evaporator 350 and then flow to the compressor 310. The second refrigerant circuit is configured to cause the refrigerant to bypass the first evaporator 340 in the first refrigerant circuit. That is, the refrigerant flows through the first evaporator 340 and the second evaporator 350 in the first refrigerant circuit, and flows through only the second evaporator 350 in the second refrigerant circuit. The third refrigerant circuit branches at a junction S at a downstream end of the condenser 320 from the first refrigerant circuit or the second refrigerant circuit, and is configured to cause the refrigerant to flow through an expansion device 370 and a third evaporator 360 and flow to the ejector 380. The refrigerant may flow through the first refrigerant circuit or the second refrigerant circuit, and the third refrigerant circuit.

The third refrigerant circuit includes a third-a refrigerant circuit and a third-b refrigerant circuit. The expansion device 370 includes a first expansion device 371 provided at an upstream end of the third evaporator 360, and a second expansion device 372 arranged in series with the first expansion device 371. The third-a refrigerant circuit is provided to cause the refrigerant to pass through the first expansion device 371 provided at the upstream end of the third evaporator 360. The third-b refrigerant circuit is provided to cause the refrigerant to pass through the first expansion device 371 and the second expansion device 372.

The first evaporator 340 may be arranged in a first cooling chamber 91. The second evaporator 350 and the third evaporator 360 may be arranged in a second cooling chamber 92.

A channel switch device 390 includes a first channel switch device 391 and a second channel switch device 392. The first channel switch device 391 may include a first-a valve 391*a* for opening or closing the first refrigerant circuit, and a first-b valve 391*b* for opening or closing the second refrigerant circuit. The second channel switch device 392 may include a second-a valve 392*a* for opening or closing the third-a refrigerant circuit, and a second-b valve 392*b* for opening or closing the third-b refrigerant circuit.

The refrigeration cycle 300 includes a plurality of forced draft fans adjacent to the condenser 320 and the cooling chambers 91 and 92, and a plurality of fan motors for driving the forced draft fans. In detail, the refrigeration cycle 300 includes a condenser forced draft fan 321, first cooling chamber-forced draft fan 341 and a second cooling chamber-forced draft fan 351, and a condenser fan motor 322, a first cooling-chamber fan motor 342, and a second cooling-chamber fan motor 352 for respectively driving the condenser forced draft fan 321, the first cooling chamber-forced draft fan 341, and the second cooling chamber-forced draft fan 351.

Furthermore, a first defrosting heater 343 and a second defrosting heater 353 may be respectively provided on a surface of the first evaporator 340 and a surface of the second evaporator 350 to remove frost on a surface of at least one evaporator 330.

The ejector 380 may include a nozzle part 381, a sucking part 383, a mixing part 384, and a diffuser part 385. The nozzle part 381 may include a nozzle body 381*a*, a nozzle entrance 381*b*, and a nozzle ejecting part 381*c*. The ejector 380 includes a sucking channel part 382 disposed in a concentric form with the nozzle ejecting part 381*c*.

The refrigeration cycle 300 may include a heat exchanger.

The heat exchanger is provided to exchange heat between a section of the third refrigerant circuit and an entrance of the compressor 310. It is preferable that a saturated gas or a refrigerant which is in a supersaturated state flow into the compressor 310 but a refrigerant which is in a liquid state may flow into the compressor 310. The heat exchanger may be provided to exchange heat between an exit of the condenser 320 and the entrance of the compressor 310, so that a decrease in the performance of the compressor 310 or breaking of the compressor 310 caused when the refrigerant which is in the liquid state flows thereinto may be prevented.

The heat exchanger may include a first heat exchanger 395*a* including the first expansion device 371 and the second expansion device 372 in the third refrigerant circuit, and a second heat exchanger 395*b* provided at an entrance portion of the compressor 310, and may transfer heat from the first heat exchanger 395*a* to the second heat exchanger 395*b*, thereby overheating the refrigerant which flows into the compressor 310.

The first expansion device 371, the second expansion device 372, and the heat exchanger may be integrated with one another. The heat exchanger includes an SLHX. A degree of overheating the refrigerant sucked into the compressor 310 may be secured through the SLHX and thus the compressor 310 may be prevented from being broken when a liquid refrigerant flows thereinto.

The above process will be described with reference to the Mollier chart below.

A process in which the refrigerant flows through the first heat exchanger 395*a*, the first expansion device 371, and the second expansion device 372 (2→10) and a process in which the refrigerant flows through the second heat exchanger 395*b*, i.e., a process in which the refrigerant flows from an ejecting part of the second evaporator 350 to the compressor 310 (8"→8) are different from the Mollier chart in the first embodiment.

That is, since heat from the first heat exchanger 395*a* is transferred to the second heat exchanger 395*b*, an enthalpy in a state 10 in which the refrigerant passes through the first heat exchanger 395*a*, the first expansion device 371, and the second expansion device 372 is lower than that in the state 10 of the first embodiment in which the refrigerant passes through the first expansion device 171. Information regarding a change of a decrease in the enthalpy caused by this state change is transferred as information regarding a change of an increase in an enthalpy of the refrigerant flowing into the compressor 310. An enthalpy in a state 8 in which the refrigerant passes through the second heat exchanger 395*b* is greater than that in the state of the first embodiment in which the refrigerant flows through the heat exchanger.

Through the above process, the cooling capability of the third evaporator 360 may be increased and a degree of overheating a refrigerant sucked into the compressor 310 may be secured, and thus breaking of the compressor 310 may be prevented and the reliability thereof may be improved.

A refrigeration cycle in accordance with a fourth embodiment of the present invention and a refrigerator including the same will be described below.

FIG. 11 is a diagram illustrating a refrigeration cycle in accordance with the fourth embodiment of the present invention. FIGS. 12A and 12B are diagrams illustrating a flow of a refrigerant in the refrigeration cycle in accordance with the fourth embodiment of the present invention. FIG. 12A illustrates the flow of the refrigerant in the whole cooling mode. FIG. 12B illustrates the flow of the refrigerant in the freezing/cooling mode.

Elements of the fourth embodiment which are the same as those of the first embodiment are not described in detail here.

A refrigeration cycle 400 includes a first refrigerant circuit, a second refrigerant circuit, and a third refrigerant circuit.

The first refrigerant circuit is configured to cause a refrigerant ejected from a compressor 410 to flow through a condenser 420, an ejector 480, a first evaporator 440, and a second evaporator 450 and flow back to the compressor 410. The second refrigerant circuit is configured to cause the refrigerant to bypass the first evaporator 440 in the first refrigerant circuit. That is, the refrigerant may flow through the first evaporator 440 and the second evaporator 450 in the first refrigerant circuit, and flow through only the second evaporator 450 in the second refrigerant circuit. The third refrigerant circuit branches at a junction S at a downstream end of the condenser 420 from the first refrigerant circuit or the second refrigerant circuit, and is configured to cause the refrigerant to flow through an expansion device 470 and a third evaporator 460 and flow to the ejector 480. The refrigerant may flow through the first refrigerant circuit or the second refrigerant circuit, and the third refrigerant circuit.

The third refrigerant circuit includes a third-a refrigerant circuit and a third-b refrigerant circuit. The expansion device 470 includes a first expansion device 471 provided at an upstream end of the third evaporator 460, and a second expansion device 472 disposed in series with the first expansion device 471. The third-a refrigerant circuit is configured to cause the refrigerant to flow through the first expansion device 471 provided at the upstream end of the third evaporator 460. The third-b refrigerant circuit may be configured to cause the refrigerant to flow through the first expansion device 471 and the second expansion device 472.

The first evaporator 440 may be arranged in a first cooling chamber 91. The second evaporator 450 and the third evaporator 460 may be arranged in a second cooling chamber 92.

A channel switch device 490 includes a first channel switch device 491 and a second channel switch device 492. The first channel switch device 491 may include a first-a valve 491*a* for opening or closing the first refrigerant circuit, and a first-b valve 491*b* for opening or closing the second refrigerant circuit. The second channel switch device 492 may include a second-a valve 492*a* for opening or closing the third-a refrigerant circuit, and a second-b valve 492*b* for opening or closing the third-b refrigerant circuit.

The refrigeration cycle 400 includes a plurality of forced draft fans adjacent to the condenser 420 and the cooling chambers 91 and 92, and a plurality of fan motors for driving the forced draft fans. In detail, the refrigeration cycle 400 includes a condenser forced draft fan 421, a first cooling chamber-forced draft fan 441, and a second cooling chamber-forced draft fan 451, and a condenser fan motor 422, a first cooling-chamber fan motor 442, and a second cooling-chamber fan motor 452 for respectively driving the condenser forced draft fan 421, the first cooling chamber-forced draft fan 441, and the second cooling chamber-forced draft fan 451.

A first defrosting heater 443 and a second defrosting heater 453 may be respectively provided on a surface of the first evaporator 440 and a surface of the second evaporator 450 to remove frost on a surface of at least one evaporator 430.

The ejector 480 may include a nozzle part 481, a sucking part 483, a mixing part 484, and a diffuser part 485. The nozzle part 481 may include a nozzle body 481*a*, a nozzle entrance 481*b*, and a nozzle ejecting part 481*c*. The ejector 480 includes a sucking channel part 482 disposed in a concentric form with the nozzle ejecting part 481*c*.

The refrigeration cycle 400 may include a heat exchanger.

The heat exchanger is provided to exchange heat between a section of the third refrigerant circuit and an entrance of the compressor 410 and between the entrance of the compressor 410 and an ejecting part of the condenser 420. It is preferable that a saturated gas or a refrigerant which is in a supersaturated state flow into the compressor 410 but a refrigerant which is in a liquid state may flow into the compressor 410. The heat exchanger may be provided to exchange heat between an exit of the condenser 420 and the entrance of the compressor 410, so that a decrease in the performance of the compressor 410 or breaking of the compressor 410 caused when the refrigerant which is in the liquid state flows thereinto may be prevented.

The heat exchanger may include a first heat exchanger 495*a* including the first expansion device 471 in the third refrigerant circuit, a second heat exchanger 495*b* and a third heat exchanger 496*a* provided at an entrance portion of the compressor 410, and a fourth heat exchanger 496*b* provided at the ejecting part of the condenser 420. A refrigerant which flows into the compressor 410 may be overheated by transferring heat from the first heat exchanger 495*a* to the second heat exchanger 495*b* and transferring heat from the fourth heat exchanger 496*b* to the third heat exchanger 496*a*. The second heat exchanger 495*b* and the third heat exchanger 496*a* have been illustrated and described separately but may be integrated with each other.

The first expansion device 471 and the heat exchanger may be integrated with each other. The heat exchanger includes an SLHX. A degree of overheating the refrigerant sucked into the compressor 410 may be secured through the SLHX and thus the compressor 410 may be prevented from being broken when a liquid refrigerant flows thereinto.

The above process will be described with reference to the Mollier chart below.

A process in which the refrigerant flows through the first heat exchanger 495*a* and the first expansion device 471 (9→10), a process in which the refrigerant ejected from the condenser 420 flows through the fourth heat exchanger 496*b* (2"→2), and a process in which the refrigerant flows from an ejecting part of the second evaporator 450 to the compressor 410, i.e., a process in which the refrigerant flows through the second heat exchanger 495*b* and the third heat exchanger 496*a* (8"→8) are different from the Mollier chart in the first embodiment. That is, since heat from the first heat exchanger 495*a* is transferred to the second heat exchanger 495*b*, an enthalpy in a state 10 in which the refrigerant passes through the first heat exchanger 495*a* and the first expansion device 471 is lower than that in the state 10 of the first embodiment in which the refrigerant passes through the first expansion device 171. Information regarding a change of a decrease in the enthalpy caused by this state change is transferred as information regarding a change of an increase in an enthalpy of the refrigerant flowing into the compressor 410. Furthermore, since heat from the fourth heat exchanger 496*b* is transferred to the third heat exchanger 496*a*, an enthalpy in a state 2 in which the refrigerant flows through the condenser 420 and the fourth heat exchanger 496*b* is lower than that in a state 2 in which the refrigerant flows through the condenser 120 in the first embodiment. Information regarding a change of a decrease in the enthalpy caused by this state change is transferred as information regarding a change of an increase in an enthalpy of the refrigerant flowing into the compressor 410. That is, an enthalpy in a state 8 in which the refrigerant flows through the second heat exchanger 495*b* is greater than that in the state of the first embodiment in which the refrigerant passes through the heat exchanger.

Through the above process, the cooling capability of the third evaporator 460 may be increased and a degree of overheating the refrigerant sucked into the compressor 410 may be secured and thus breaking of the compressor 410 may be prevented and the reliability thereof may be improved.

A refrigeration cycle in accordance with a fifth embodiment of the present invention and a refrigerator including the same will be described below.

FIG. 13 is a diagram illustrating a refrigeration cycle in accordance with the fifth embodiment of the present invention. FIGS. 14A and 14B are diagrams illustrating a flow of a refrigerant in the refrigeration cycle in accordance with the fifth embodiment of the present invention refrigeration cycle. FIG. 14A illustrates the flow of the refrigerant in the whole cooling mode. FIG. 14B illustrates the flow of the refrigerant in the freezing/cooling mode.

Elements of the fifth embodiment which are the same as those of the first embodiment will not be described in detail here.

A refrigeration cycle 500 includes a first refrigerant circuit, a second refrigerant circuit, and a third refrigerant circuit.

The first refrigerant circuit is configured to cause a refrigerant ejected from a compressor 510 to flow through a condenser 520, an ejector 580, a first evaporator 540, and a second evaporator 550 and flow back to the compressor 510. The second refrigerant circuit is configured to cause the refrigerant to bypass the first evaporator 540 in the first refrigerant circuit. That is, the refrigerant may flow through the first evaporator 540 and the second evaporator 550 in the first refrigerant circuit, and flow through only the second evaporator 550 in the second refrigerant circuit. The third refrigerant circuit branches at a junction S provided at a downstream end of the condenser 520 from the first refrigerant circuit or the second refrigerant circuit, and is configured to cause the refrigerant to flow through an expansion device 570 and a third evaporator 560 and flow to the ejector 580. The refrigerant may flow through the first refrigerant circuit or the second refrigerant circuit, and the third refrigerant circuit.

The third refrigerant circuit includes a third-a refrigerant circuit and a third-b refrigerant circuit. The expansion device 570 includes a first expansion device 571 provided at an upstream end of the third evaporator 560, and a second expansion device 572 disposed in series with the first expansion device 571. The third-a refrigerant circuit is provided to cause the refrigerant to flow through first expansion device 571 provided at the upstream end of the third evaporator 560. The third-b refrigerant circuit is provided to cause the refrigerant to flow through the first expansion device 571 and the second expansion device 572.

The first evaporator 540 may be included in a first cooling chamber 91. The second evaporator 550 and the third evaporator 560 may be included in a second cooling chamber 92.

A channel switch device 590 includes a first channel switch device 591 and a second channel switch device 592. The first channel switch device 591 may include a first-a valve 591*a* for opening or closing the first refrigerant circuit, and a first-b valve 591*b* for opening or closing the second refrigerant circuit. The second channel switch device 592 may include a second-a valve 592*a* for opening or closing the third-a refrigerant circuit, and a second-b valve 592*b* for opening or closing the third-b refrigerant circuit.

The refrigeration cycle 500 includes a plurality of forced draft fans adjacent to the condenser 520 and the cooling chambers 91 and 92, and a plurality of fan motors for driving the forced draft fans. In detail, the refrigeration cycle 500 includes a condenser forced draft fan 521, a first cooling chamber-forced draft fan 541, and a second cooling chamber-forced draft fan 551, and a condenser fan motor 522, a first cooling-chamber fan motor 542, and a second cooling-chamber fan motor 552 for respectively driving the condenser forced draft fan 521, the first cooling chamber-forced draft fan 541, and the second cooling chamber-forced draft fan 551.

A first defrosting heater 543 and a second defrosting heater 553 may be respectively provided on a surface of the first evaporator 540 and a surface of the second evaporator 550 to remove frost on a surface of at least one evaporator 530.

The ejector 580 may include a nozzle part 581, a sucking part 583, a mixing part 584, and a diffuser part 585. The nozzle part 581 may include a nozzle body 581*a*, a nozzle entrance 581*b*, and a nozzle ejecting part 581*c*. The ejector 580 includes a sucking channel part 582 disposed in a concentric form with the nozzle ejecting part 581*c*. The refrigeration cycle 500 may include a heat exchanger.

The heat exchanger is provided to exchange heat between a section of the third refrigerant circuit and an entrance of the compressor 510 and between the entrance of the compressor 510 and an ejecting part of the condenser 520. It is preferable that a saturated gas or a refrigerant which is in a supersaturated state flow into the compressor 510 but a refrigerant which is in a liquid state may flow into the compressor 510. The heat exchanger may be provided to exchange heat between an exit of the condenser 520 and the entrance of the compressor 510, so that a decrease in the performance of the compressor 510 or breaking of the compressor 510 caused when the refrigerant which is in the liquid state flows thereinto may be prevented.

The heat exchanger may include a first heat exchanger 595*a* including the first expansion device 571 and the second expansion device 572 in the third refrigerant circuit, a second heat exchanger 595*b* and a third heat exchanger 596*a* provided at an entrance portion of the compressor 510, and a fourth heat exchanger 596*b* provided at the ejecting part of the condenser 520. The refrigerant flowing into the compressor 510 may be overheated by transferring heat from the first heat exchanger 595*a* to the second heat exchanger 595*b* and transferring heat from the fourth heat exchanger 596*b* to the third heat exchanger 596*a*. The second heat exchanger 595*b* and the third heat exchanger 596*a* have been illustrated and described separately but may be integrated with each other.

The first expansion device 571, the second expansion device 572, and the heat exchanger may be integrated with one another. The heat exchanger includes an SLHX. A degree of overheating the refrigerant sucked into the compressor 510 may be secured through the SLHX and thus the compressor 510 may be prevented from being broken when a liquid refrigerant flows thereinto.

The above process will be described with reference to the Mollier chart below.

A process in which the refrigerant flows through the first heat exchanger 595*a*, the first expansion device 571, and the second expansion device 572 (9→10), a process in which the refrigerant ejected from the condenser 520 flows through the fourth heat exchanger 596*b* (2"→2), and a process in which the refrigerant flows from an ejecting part of the second evaporator 550 into the compressor 510, i.e., a process in which the refrigerant flows through the second heat exchanger 595*b* and the third heat exchanger 596*a* (8"→8) are different from the Mollier chart in the first embodiment.

That is, since heat from the first heat exchanger 595*a* is transferred to the second heat exchanger 595*b*, an enthalpy in a state 10 in which the refrigerant passes through the first heat exchanger 595*a*, the first expansion device 571, and the second expansion device 572 is lower than that in the state 10 of the first embodiment in which the refrigerant passes through the first expansion device 171. Information regarding a change of a decrease in the enthalpy caused by this state change is transferred as information regarding a change of an increase in an enthalpy of the refrigerant flowing into the compressor 510. Furthermore, since heat from the fourth heat exchanger 596*b* is transferred to the third heat exchanger 596*a*, an enthalpy in a state 2 in which the refrigerant flows through the condenser 520 and the fourth heat exchanger 596*b* is lower than that in the state 2 of the first embodiment in which the refrigerant flows through the condenser 120. Information regarding a change of a decrease in the enthalpy caused by this state change is transferred as information regarding a change of an increase in an enthalpy of the refrigerant flowing into the compressor 510. In other words, an enthalpy in a state 8 in which the refrigerant passes through the second heat exchanger 595*b* is greater than that in a state of the first embodiment in which the refrigerant passes through the heat exchanger.

Through the above process, the cooling capability of the third evaporator 560 may be increased and a degree of overheating the refrigerant sucked into the compressor 510 may be secured. Therefore, breaking of the compressor 510 may be prevented and the reliability thereof may be improved.

A refrigeration cycle in accordance with a sixth embodiment of the present invention and a refrigerator including the same will be described below.

FIG. 15 is a diagram illustrating a refrigeration cycle in accordance with the sixth embodiment of the present invention. FIGS. 16A and 16B are diagrams illustrating a flow of a refrigerant in the refrigeration cycle in accordance with the sixth embodiment of the present invention. FIG. 16A illustrates the flow of the refrigerant in the whole cooling mode. FIG. 16B illustrates the flow of the refrigerant in the freezing/cooling mode.

Elements of the sixth embodiment which are the same as those of the first embodiment are not described in detail here.

A refrigeration cycle 600 includes a first refrigerant circuit, a second refrigerant circuit, and a third refrigerant circuit.

The first refrigerant circuit is configured to cause a refrigerant ejected from a compressor 610 to flow through a condenser 620, an ejector 680, a first evaporator 640, and a second evaporator 650 and flow back to the compressor 610. The second refrigerant circuit is configured to cause the refrigerant to bypass the first evaporator 640 in the first refrigerant circuit. That is, the refrigerant may flow through the first evaporator 640 and the second evaporator 650 in the first refrigerant circuit, and flow through only the second evaporator 650 in the second refrigerant circuit. The third refrigerant circuit branches at a junction S provided at a downstream end of the condenser 620 from the first refrigerant circuit or the second refrigerant circuit, and is configured to cause the refrigerant to flow through an expansion device 670 and a third evaporator 660 and flow to the ejector 680. The refrigerant may flow through the first refrigerant circuit or the second refrigerant circuit, and the third refrigerant circuit.

The third refrigerant circuit includes a third-a refrigerant circuit and a third-b refrigerant circuit. The expansion device 670 includes a first expansion device 671 provided at an upstream end of the third evaporator 660, and a second expansion device 672 disposed in series with the first expansion device 671. The third-a refrigerant circuit is provided to cause the refrigerant to flow through the first expansion device 671 provided at the upstream end of the third evaporator 660. The third-b refrigerant circuit is provided to cause the refrigerant to flow through the first expansion device 671 and the second expansion device 672.

The first evaporator 640 may be included in a first cooling chamber 91. The second evaporator 650 and the third evaporator 660 may be included in a second cooling chamber 92.

A channel switch device 690 includes a first channel switch device 691 and a second channel switch device 692. The first channel switch device 691 may include a first-a valve 691*a* for opening or closing the first refrigerant circuit, and a first-b valve 691*b* for opening or closing the second refrigerant circuit. The second channel switch device 692 may include a second-a valve 692*a* for opening or closing the third-a refrigerant circuit, and a second-b valve 692*b* for opening or closing the third-b refrigerant circuit.

The refrigeration cycle 600 includes a plurality of forced draft fans adjacent to the condenser 620 and the cooling chambers 91 and 92, and a plurality of fan motors for driving the forced draft fans. In detail, the refrigeration cycle 600 includes a condenser forced draft fan 621, a first cooling chamber-forced draft fan 641, and a second cooling chamber-forced draft fan 651, and a condenser fan motor 622, a first cooling-chamber fan motor 642, and a second cooling-chamber fan motor 652 for respectively driving the condenser forced draft fan 621, the first cooling chamber-forced draft fan 641, and the second cooling chamber-forced draft fan 651.

A first defrosting heater 643 and a second defrosting heater 653 may be respectively provided on a surface of the first evaporator 640 and a surface of the second evaporator 650 to remove frost on a surface of at least one evaporator 630.

The ejector 680 may include a nozzle part 681, a sucking part 683, a mixing part 684, and a diffuser part 685. The nozzle part 681 may include a nozzle body 681*a*, a nozzle entrance 681*b*, and a nozzle ejecting part 681*c*. The ejector 680 may include a sucking channel part 682 disposed in a concentric form with the nozzle ejecting part 681*c*.

The refrigeration cycle 600 may include a heat exchanger. The heat exchanger is provided to exchange heat between a section of the third refrigerant circuit and an entrance of the compressor 610 and between the entrance of the compressor 610 and the sucking part 683 of the ejector 680. It is preferable that a saturated gas or a refrigerant which is in a supersaturated state flow into the compressor 610 but a refrigerant which is in a liquid state may flow into the compressor 610. The heat exchanger may be provided to exchange heat between an exit of the condenser 620 and the entrance of the compressor 610, so that a decrease in the performance of the compressor 610 or breaking of the compressor 610 caused when the refrigerant which is the liquid state flows thereinto may be prevented.

The heat exchanger may include a first heat exchanger 695*a* including the first expansion device 671 in the third refrigerant circuit, a second heat exchanger 695*b* and a third heat exchanger 696*a* provided at an entrance portion of the compressor 610, and a fourth heat exchanger 696*b* provided at the sucking part 683 of the ejector 680. The refrigerant flowing into the compressor 610 may be overheated by transferring heat from the first heat exchanger 695*a* to the second heat exchanger 695*b* and transferring heat from the fourth heat exchanger 696*b* to the third heat exchanger 696*a*. The second heat exchanger 695*b* and the third heat exchanger 696*a* have been illustrated and described separately but may be integrated with each other.

The first expansion device 671 and the heat exchanger may be integrated with each other. The heat exchanger includes an SLHX. A degree of overheating the refrigerant sucked into the compressor 610 may be secured through the SLHX and thus the compressor 610 may be prevented from being broken when a liquid refrigerant flows thereinto.

The above process will be described with reference to the Mollier chart below.

A process in which the refrigerant flows through the first heat exchanger 695*a* and the first expansion device 671 (9→10), a process in which the refrigerant flowing into the ejector 680 flows through the fourth heat exchanger 696*b* (2"→2), and a process in which the refrigerant flows from an ejecting part of the second evaporator 650 to the compressor 610, i.e., a process in which the refrigerant flows through the second heat exchanger 695*b* and the third heat exchanger 696*a* (8"→8) are different from the Mollier chart in the first embodiment.

That is, since heat from the first heat exchanger 695*a* is transferred to the second heat exchanger 695*b*, an enthalpy in a state 10 in which the refrigerant passes through the first heat exchanger 695*a* and the first expansion device 671 is lower than that in the state 10 of the first embodiment in which the refrigerant passes through the first expansion device 171. Information regarding a change of a decrease in the enthalpy caused by this state change is transferred as information regarding a change of an increase in an enthalpy of the refrigerant flowing into the compressor 610. Furthermore, since heat from the fourth heat exchanger 696*b* is transferred to the third heat exchanger 696*a*, an enthalpy in a state 2 in which the refrigerant flows through the condenser 620 and the fourth heat exchanger 696*b* is lower than that in the state 2 of the first embodiment in which the refrigerant flows through the condenser 120. Information regarding a change of a decrease in the enthalpy caused by this state change is transferred as information regarding a change of an increase in the enthalpy of the refrigerant flowing into the compressor 610. That is, an enthalpy in a state 8 in which the refrigerant passes through the second heat exchanger 695*b* is greater than that in the state of the first embodiment in which the refrigerant flows through the heat exchanger.

Through the above process, the cooling capability of the third evaporator 660 may be increased and a degree of overheating the refrigerant sucked into the compressor 610 may be secured. Therefore, breaking of the compressor 610 may be prevented and the reliability thereof may be improved.

A refrigeration cycle in accordance with a seventh embodiment of the present invention and a refrigerator including the same will be described below.

FIG. 17 is a diagram illustrating a refrigeration cycle in accordance with the seventh embodiment of the present invention. FIGS. 18A and 18B are diagrams illustrating a flow of a refrigerant in the refrigeration cycle in accordance with the seventh embodiment of the present invention. FIG. 18A illustrates the flow of the refrigerant in the whole cooling mode. FIG. 18B illustrates the flow of the refrigerant in the freezing/cooling mode.

Elements of the seventh embodiment which are the same as those of the first embodiment are not described in detail here.

A refrigeration cycle 700 includes a first refrigerant circuit, a second refrigerant circuit, and a third refrigerant circuit.

The first refrigerant circuit is configured to cause a refrigerant ejected from a compressor 710 to flow through a condenser 720, an ejector 780, a first evaporator 740, and a second evaporator 750 and then flow back to the compressor 710. The second refrigerant circuit is configured to cause the refrigerant to bypass the first evaporator 740 in the first refrigerant circuit. That is, the refrigerant flows through the first evaporator 740 and the second evaporator 750 in the first refrigerant circuit, and flow through only the second evaporator 750 in the second refrigerant circuit. The third refrigerant circuit branches at a junction S provided at a downstream end of the condenser 720 from the first refrigerant circuit or the second refrigerant circuit, and is configured to cause the refrigerant to flow through an expansion device 770 and a third evaporator 760 and flow to the ejector 780. The refrigerant may flow through the first refrigerant circuit or the second refrigerant circuit, and the third refrigerant circuit.

The third refrigerant circuit includes a third-a refrigerant circuit and a third-b refrigerant circuit. The expansion device 770 includes a first expansion device 771 provided at an upstream end of the third evaporator 760, and a second expansion device 772 disposed in series with the first expansion device 771. The third-a refrigerant circuit is provided to cause the refrigerant to flow through the first expansion device 771 provided at the upstream end of the third evaporator 760. The third-b refrigerant circuit is provided to cause the refrigerant to flow through the first expansion device 771 and the second expansion device 772.

The first evaporator 740 may be arranged in a first cooling chamber 91, and the second evaporator 750 and the third evaporator 760 may be arranged in a second cooling chamber 92.

A channel switch device 790 includes a first channel switch device 791 and a second channel switch device 792. The first channel switch device 791 may include a first-a valve 791*a* for opening or closing the first refrigerant circuit, and a first-b valve 791*b* for opening or closing the second refrigerant circuit. The second channel switch device 792 may include a second-a valve 792*a* for opening or closing the third-a refrigerant circuit, and a second-b valve 792*b* for opening or closing the third-b refrigerant circuit.

The refrigeration cycle 700 includes a plurality of forced draft fans adjacent to the condenser 720 and the cooling chambers 91 and 92, and a plurality of fan motors for driving the forced draft fans. In detail, the refrigeration cycle 700 includes a condenser forced draft fan 721, a first cooling chamber-forced draft fan 741, and a second cooling chamber-forced draft fan 751, and a condenser fan motor 722, a first cooling-chamber fan motor 742, and a second cooling-chamber fan motor 752 for respectively driving the condenser forced draft fan 721, the first cooling chamber-forced draft fan 741, and the second cooling chamber-forced draft fan 751.

A first defrosting heater 743 and a second defrosting heater 753 may be respectively provided on a surface of the first evaporator 740 and a surface of the second evaporator 750 to remove frost on a surface of at least one evaporator 730.

The ejector 780 may include a nozzle part 781, a sucking part 783, a mixing part 784, and a diffuser part 785. The nozzle part 781 may include a nozzle body 781*a*, a nozzle entrance 781*b*, and a nozzle ejecting part 781*c*. The ejector 780 includes a sucking channel part 782 disposed in a concentric form with the nozzle ejecting part 781*c*.

The refrigeration cycle 700 may include a heat exchanger.

The heat exchanger is provided to exchange heat between a section of the third refrigerant circuit and an entrance of the compressor 710 and between the entrance of the compressor 710 and the sucking part 783 of the ejector 780. It is preferable that a saturated gas or a refrigerant which is in a supersaturated state flow into the compressor 710 but a refrigerant which is in a liquid state may flow into the compressor 710. The heat exchanger may be provided to exchange heat between an exit of the condenser 220 and the entrance of the compressor 710, so that a decrease in the performance of the compressor 710 or breaking of the compressor 710 caused when the refrigerant which is in the liquid state flows thereinto may be prevented.

The heat exchanger may include a first heat exchanger 795*a* including the first expansion device 771 and the second expansion device 772 in the third refrigerant circuit, a second heat exchanger 795*b* and a third heat exchanger 796*a* provided at an entrance portion of the compressor 710, and a fourth heat exchanger 796*b* provided at the sucking part 783 of the ejector 780. The heat exchanger may overheat the refrigerant which flows into the compressor 710 by transferring heat from the first heat exchanger 795*a* to the second heat exchanger 795*b* and transferring heat from the fourth heat exchanger 796*b* to the third heat exchanger 796*a*. The second heat exchanger 795*b* and the third heat exchanger

796*a* have been illustrated and described separately but may be integrated with each other.

The first expansion device 771, the second expansion device 772, and the heat exchanger may be integrated with one another. The heat exchanger includes an SLHX. A degree of overheating the refrigerant sucked into the compressor 710 may be secured through the SLHX and thus the compressor 710 may be prevented from being broken when a liquid refrigerant flows thereinto.

The above process will be described with reference to the Mollier chart below.

A process in which the refrigerant flows through the first heat exchanger 795*a*, the first expansion device 771, and the second expansion device 772 (9→10), a process in which the refrigerant flowing into the ejector 780 flows through the fourth heat exchanger 796*b* (2"→2), and a process in which the refrigerant flows from an ejecting part of the second evaporator 750 to the compressor 710, i.e., a process in which the refrigerant flows through the second heat exchanger 795*b* and the third heat exchanger 796*a* (8"→8) are different from the Mollier chart in the first embodiment.

That is, since heat from the first heat exchanger 795*a* is transferred to the second heat exchanger 795*b*, an enthalpy in a state 10 in which the refrigerant passes through the first heat exchanger 795*a*, the first expansion device 771, and the second expansion device 772 is lower than that in the state 10 of the first embodiment in which the refrigerant passes through the first expansion device 171. Information regarding a change of a decrease in the enthalpy caused by this state change is transferred as information regarding a change of an increase in an enthalpy of the refrigerant flowing into the compressor 710. Furthermore, since heat from the fourth heat exchanger 796*b* is transferred to the third heat exchanger 796*a*, an enthalpy in a state 2 in which the refrigerant flows through the condenser 720 and the fourth heat exchanger 796*b* is lower than that in the state 2 of the first embodiment in which the refrigerant flows through the condenser 120. Information regarding a change of a decrease in the enthalpy caused by this state change is transferred as information regarding a change of an increase in an enthalpy of the refrigerant flowing into the compressor 710. That is, an enthalpy in a state 8 in which the refrigerant passes through the second heat exchanger 795*b* is greater than that in the state of the first embodiment in which the refrigerant flows through the heat exchanger.

Through the above process, the cooling capability of the third evaporator 760 may be increased and a degree of overheating the refrigerant sucked into the compressor 710 may be secured. Thus, breaking of the compressor 710 may be prevented and the reliability thereof may be improved.

A refrigeration cycle in accordance with an eighth embodiment of the present invention and a refrigerator including the same will be described below.

FIG. 19 is a diagram illustrating a refrigeration cycle in accordance with the eighth embodiment of the present invention. FIGS. 20A and 20B are diagrams illustrating a flow of a refrigerant in the refrigeration cycle in accordance with the eighth embodiment of the present invention. FIG. 20A illustrates the flow of the refrigerant in the whole cooling mode. FIG. 20B illustrates the flow of the refrigerant in the freezing/cooling mode.

Elements of the eighth embodiment which are the same as those of the first embodiment are not described in detail here.

A refrigeration cycle 800 includes a first refrigerant circuit, a second refrigerant circuit, and a third refrigerant circuit.

The first refrigerant circuit is configured to cause a refrigerant ejected from a compressor 810 to flow through a condenser 820, an ejector 880, a first evaporator 840, and a second evaporator 850 and flow back to the compressor 810. The second refrigerant circuit is configured to cause the refrigerant to bypass the first evaporator 840 in the first refrigerant circuit. That is, the refrigerant may flow through first evaporator 840 and the second evaporator 850 in the first refrigerant circuit, and flow through only the second evaporator 850 in the second refrigerant circuit. The third refrigerant circuit branches at a junction S at a downstream end of the condenser 820 from the first refrigerant circuit or the second refrigerant circuit, and is configured to cause the refrigerant to flow through an expansion device 870 and a third evaporator 860 and then flow to the ejector 880. The refrigerant may flow through the first refrigerant circuit or the second refrigerant circuit, and the third refrigerant circuit.

The third refrigerant circuit includes a third-a refrigerant circuit and a third-b refrigerant circuit. The expansion device 870 includes a first expansion device 871 provided at an upstream end of the third evaporator 860, and a second expansion device 872 disposed in series with the first expansion device 871. The third-a refrigerant circuit is provided to cause the refrigerant to flow through the first expansion device 871 provided at the upstream end of the third evaporator 860. The third-b refrigerant circuit is provided to cause the refrigerant to flow through the first expansion device 871 and the second expansion device 872.

The first evaporator 840 may be arranged in a first cooling chamber 91. The second evaporator 850 and the third evaporator 860 may be arranged in a second cooling chamber 92.

A channel switch device 890 includes a first channel switch device 891 and a second channel switch device 892. The first channel switch device 891 may include a first-a valve 891*a* for opening or closing the first refrigerant circuit, and a first-b valve 891*b* for opening or closing the second refrigerant circuit. The second channel switch device 892 may include a second-a valve 892*a* for opening or closing the third-a refrigerant circuit, and a second-b valve 892*b* for opening or closing the third-b refrigerant circuit.

The refrigeration cycle 800 includes a plurality of forced draft fans adjacent to the condenser 820 and the cooling chambers 91 and 92, and a plurality of fan motors for driving the forced draft fans. In detail, the refrigeration cycle 800 includes a condenser forced draft fan 821, a first cooling chamber-forced draft fan 841, and a second cooling chamber-forced draft fan 851, and a condenser fan motor 822, a first cooling-chamber fan motor 842, and a second cooling-chamber fan motor 852 for respectively driving the condenser forced draft fan 821, the first cooling chamber-forced draft fan 841, and the second cooling chamber-forced draft fan 851.

A first defrosting heater 843 and a second defrosting heater 853 may be respectively provided on a surface of the first evaporator 840 and on a surface of the second evaporator 850 to remove frost on a surface of at least one evaporator 830.

The ejector 880 may include a nozzle part 881, a sucking part 883, a mixing part 884, and a diffuser part 885. The nozzle part 881 may include a nozzle body 881*a*, a nozzle entrance 881*b*, and a nozzle ejecting part 881*c*. The ejector 880 includes a sucking channel part 882 disposed in a concentric form with the nozzle ejecting part 881*c*.

The refrigeration cycle 800 may include a heat exchanger.

The heat exchanger is provided to exchange heat between an entrance of the compressor 810 and an ejecting part of the condenser 820. It is preferable that a saturated gas or a refrigerant which is in a supersaturated state flow into the compressor 810 but a refrigerant which is in a liquid state may flow into the compressor 810. The heat exchanger may be provided to exchange heat between an exit of the condenser 820 and the entrance of the compressor 810, so that a decrease in the performance of the compressor 810 or breaking of the compressor 810 caused when the refrigerant which is in the liquid state flows thereinto may be prevented.

The heat exchanger may include a first heat exchanger 895*a* provided at an entrance portion of the compressor 810, and a second heat exchanger 895*b* provided at the ejecting part of the condenser 820. The refrigerant flowing into the compressor 810 may be overheated by transferring heat from the second heat exchanger 895*b* to the first heat exchanger 895*a*.

The refrigeration cycle 800 includes third expansion devices 873 and 870 provided at the ejecting part of the condenser 820 and configured to decrease temperature and pressure of the refrigerant ejected from the condenser 820. The third expansion devices 873 and 870 may be provided between the condenser 820 and the ejector 880. When the refrigerant flowing into the nozzle part 881 of the ejector 880 is in a 2-phase state, the efficiency of the ejector 880 is improved. Thus, the third expansion devices 873 and 870 are provided to increase the degree of dryness of a liquid refrigerant ejected from the condenser 820.

The third expansion devices 873 and 870 may be integrated with the heat exchanger. The heat exchanger includes an SLHX. A degree of overheating the refrigerant sucked into the compressor 810 may be secured through the SLHX and thus the compressor 810 may be prevented from being broken when a liquid refrigerant flows thereinto.

The above process will be described with reference to the Mollier chart below.

A process in which the refrigerant ejected from the condenser 820 flows through the second heat exchanger 895*b* (2"→2) and a process in which the refrigerant flows from an ejecting part of the second evaporator 850 to the compressor 810, i.e., a process in which the refrigerant flows through the first heat exchanger 895*a* (8"→8) are different from the Mollier chart in the first embodiment.

That is, since heat from the second heat exchanger 895*b* is transferred to the first heat exchanger 895*a*, an enthalpy in a state 2 in which the refrigerant flows through condenser 820 and the second heat exchanger 895*b* is lower than that in the state 2 of the first embodiment in which the refrigerant flows through the condenser 120. Information regarding a change of a decrease in the enthalpy caused by this state change is transferred as information regarding a change of an increase in an enthalpy of the refrigerant flowing into the compressor 810. That is, an enthalpy in a state 8 in which the refrigerant passes through the second heat exchanger 895*b* is greater than that in the state of the first embodiment in which the refrigerant flows through the heat exchanger.

Through the above process, the cooling capability of the third evaporator 860 may be increased and a degree of overheating the refrigerant sucked into the compressor 810 may be secured. Thus, breaking of the compressor 810 may be prevented and the reliability thereof may be improved.

A refrigeration cycle in accordance with a ninth embodiment of the present invention and a refrigerator including the same will be described below.

FIG. 21 is a diagram illustrating a refrigeration cycle in accordance with the ninth embodiment of the present invention. FIGS. 22A and 22B are diagrams illustrating a flow of a refrigerant in the refrigeration cycle in accordance with the ninth embodiment of the present invention. FIG. 22A illustrates the flow of the refrigerant in the whole cooling mode. FIG. 22B illustrates the flow of the refrigerant in the freezing/cooling mode.

Elements of the ninth embodiment which are the same as those of the first embodiment are not described in detail here.

A refrigeration cycle 900 includes a first refrigerant circuit, a second refrigerant circuit, and a third refrigerant circuit.

The first refrigerant circuit is configured to cause a refrigerant ejected from a compressor 910 to flow through a condenser 920, an ejector 980, and a first evaporator 940 and then flow back to the compressor 910. The second refrigerant circuit is configured to cause the refrigerant to flow through a second evaporator 950 disposed in parallel with the first evaporator 940 in the first refrigerant circuit. That is, the refrigerant may flow through only the first evaporator 940 in the first refrigerant circuit, and flow through only the second evaporator 950 in the second refrigerant circuit. The third refrigerant circuit branches at a junction S provided at a downstream end of the condenser 920 from the first refrigerant circuit or the second refrigerant circuit, and is configured to cause the refrigerant to flow through an expansion device 970 and a third evaporator 960 and then flow to the ejector 980. The refrigerant may flow through the first refrigerant circuit or the second refrigerant circuit, and the third refrigerant circuit.

The third refrigerant circuit includes a third-a refrigerant circuit and a third-b refrigerant circuit. The expansion device 970 includes a first expansion device 971 provided at an upstream end of the third evaporator 960, and a second expansion device 972 disposed in series with the first expansion device 971. The third-a refrigerant circuit is provided to cause the refrigerant to flow through the first expansion device 971 provided at the upstream end of the third evaporator 960. The third-b refrigerant circuit is provided to cause the refrigerant to flow through the first expansion device 971 and the second expansion device 972.

The first evaporator 940 may be arranged in a first cooling chamber 91. The second evaporator 950 and the third evaporator 960 may be arranged in a second cooling chamber 92.

A channel switch device 990 includes a first channel switch device 991 and a second channel switch device 992. The first channel switch device 991 may include a first-a valve 991*a* for opening or closing the first refrigerant circuit, and a first-b valve 991*b* for opening or closing the second refrigerant circuit. The second channel switch device 992 may include a second-a valve 992*a* for opening or closing the third-a refrigerant circuit, and a second-b valve 992*b* for opening or closing the third-b refrigerant circuit.

In the present embodiment, the refrigerant is controlled by the first channel switch device 991 to flow through the first evaporator 940 or the second evaporator 950, unlike in the first embodiment. Due to the above structure, a refrigeration/cooling mode in which a refrigerant flows through the first refrigerant circuit and the third-a refrigerant circuit and a freezing/cooling mode in which a refrigerant flows through the second refrigerant circuit and the third-b refrigerant circuit are provided. A defrosting mode is the same as that in the first embodiment.

In the present embodiment, the first cooling chamber 91 and the second cooling chamber 92 may be selectively and intensively cooled through the refrigeration cycle 900. Thus, refrigeration efficiency may be improved during the intensive cooling.

The refrigeration cycle 900 includes a plurality of forced draft fans adjacent to the condenser 920 and the cooling chambers 91 and 92, and a plurality of fan motors for driving the forced draft fans. In detail, the refrigeration cycle 900 includes a condenser forced draft fan 921, a first cooling chamber-forced draft fan 941, and a second cooling chamber-forced draft fan 951, and a condenser fan motor 922, a first cooling-chamber fan motor 942, and a second cooling-chamber fan motor 952 for respectively driving the condenser forced draft fan 921, the first cooling chamber-forced draft fan 941, and the second cooling chamber-forced draft fan 951.

A first defrosting heater 943 and a second defrosting heater 953 may be respectively provided on a surface of the first evaporator 940 and a surface of the second evaporator 950 to remove frost on a surface of at least one evaporator 930.

The ejector 980 may include a nozzle part 981, a sucking part 983, a mixing part 984, and a diffuser part 985. The nozzle part 981 may include a nozzle body 981*a*, a nozzle entrance 981*b*, and a nozzle ejecting part 981*c*. The ejector 980 includes a sucking channel part 982 disposed in a concentric form with the nozzle ejecting part 981*c*.

The above process will be described with reference to the Mollier chart below.

A process in which the refrigerant flows through the first refrigerant circuit in the refrigeration/cooling mode by being ejected from the ejector 980 and controlled by the first channel switch device 991 to flow through the first evaporator 940 and a process in which the refrigerant flows through the second refrigerant circuit in the freezing/cooling mode by being ejected from the ejector 980 and controlled by the first channel switch device 991 to flow through the second evaporator 950 are different from the Mollier chart in the first embodiment.

That is, the first cooling chamber 91 or the second cooling chamber 92 may selectively be cooled and thus the first or second cooling chamber 91 or 92 which needs be cooled may be intensively cooled.

A refrigeration cycle in accordance with a tenth embodiment of the present invention and a refrigerator including the same will be described below.

FIG. 23 is a diagram illustrating a refrigeration cycle in accordance with the tenth embodiment of the present invention. FIG. 24 is a diagram illustrating a flow of a refrigerant in the refrigeration cycle in accordance with the tenth embodiment of the present invention.

Elements of the tenth embodiment which are the same as those of the first embodiment are not described in detail here.

A refrigeration cycle 1000 includes a first refrigerant circuit and a second refrigerant circuit.

The first refrigerant circuit is configured to cause a refrigerant ejected from a compressor 1010 to flow through a condenser 1020, a first expansion device 1071, and a first evaporator 1040 and flow back to the compressor 1010.

The second refrigerant circuit is configured to cause the refrigerant to bypass the first expansion device 1071 and the first evaporator 1040 from a downstream end of the condenser 1020 in the first refrigerant circuit, flow through an ejector 1080, a second evaporator 1050, a third evaporator 1060, and a second expansion device 1072, and flow back to the compressor 1010.

The second refrigerant circuit includes a second-a refrigerant circuit in which the refrigerant flows through the ejector 1080 and the second evaporator 1050 and then flows to the compressor 1010, and a second-b refrigerant circuit in which the refrigerant branches from an upstream end of the ejector 1080 in the second-a refrigerant circuit, flows through the second expansion device 1072 and the third evaporator 1060, and flows into a sucking part 1083 of the ejector 1080.

The first evaporator 1040 may be provided to cool a first cooling chamber 91. The second evaporator 1050 and the third evaporator 1060 may be provided to cool a second cooling chamber 92. A temperature of the second cooling chamber 92 may be set to be lower than that of the first cooling chamber 91. The first cooling chamber 91 may be understood as the refrigeration chamber of a refrigerator 80, and the second cooling chamber 92 may be understood as the freezer of the refrigerator 80.

The refrigeration cycle 1000 may be provided to be operated in a refrigeration/cooling mode and a freezing/cooling mode.

The refrigeration/cooling mode is an operating mode in which is the first cooling chamber 91 is cooled. That is, the refrigerant may flow through only the first evaporator 1040 in the refrigeration/cooling mode. The refrigerant may flow through the first refrigerant circuit in the refrigeration/cooling mode.

The freezing/cooling mode is an operating mode in which the second cooling chamber 92 is cooled. That is, in the freezing/cooling mode, the refrigerant may flow through the second evaporator 1050 and the third evaporator 1060. In the freezing/cooling mode, the refrigerant may flow through the second refrigerant circuit.

In the refrigeration/cooling mode and the freezing/cooling mode, the number of evaporators 1030 through which the refrigerant flows is different and thus a flow rate of the refrigerant needs to be adjusted. To this end, the compressor 1010 may include an inverter compressor. It is possible to switch between the refrigeration/cooling mode and the freezing/cooling mode by controlling the flow rate of the refrigerant flowing through a refrigerant circuit through control of the RRM of the inverter compressor.

A channel switch device 1091 is provided to control the flow of the refrigerant between the first refrigerant circuit and the second refrigerant circuit. In detail, the refrigerant ejected from the condenser 1020 may flow through the first refrigerant circuit or the second refrigerant circuit.

In detail, the channel switch device 1091 is provided to move the refrigerant to either the first refrigerant circuit in which the refrigerant flows through the first evaporator 1040 or the second refrigerant circuit in which the refrigerant flows through the second evaporator 1050 and the third evaporator 1060.

The channel switch device 1091 may include a 3-way valve. The channel switch device 1091 may include a first valve 1091*a* for opening or closing the first refrigerant circuit, and a second valve 1091*b* for opening or closing the second refrigerant circuit.

The ejector 1080 may include a nozzle part 1081, the sucking part 1083, a mixing part 1084, and a diffuser part 1085. The nozzle part 1081 may include a nozzle body 1081*a*, a nozzle entrance 1081*b*, and a nozzle ejecting part 1081*c*. The ejector 1080 includes a sucking channel part 1082 disposed in a concentric form with the nozzle ejecting part 1081*c*.

The refrigeration cycle 1000 may include a heat exchanger.

The heat exchanger is provided to exchange heat between an entrance of the compressor 1010 and an ejecting part of the condenser 1020. It is preferable that a saturated gas or a refrigerant which is in a supersaturated state flow into the compressor 1010 but a refrigerant which is in a liquid state may flow into the compressor 1010. The heat exchanger may be provided to exchange heat between an exit of the condenser 1020 and the entrance of the compressor 1010, so that a decrease in the performance of the compressor 1010 or breaking of the compressor 1010 caused when the refrigerant which is in the liquid state flows thereinto may be prevented.

The heat exchanger may include a first heat exchanger 1095*a* located at a downstream end of the first evaporator 1040 in the first refrigerant circuit, and a second heat exchanger 1095*b* located at the downstream end of the condenser 1020 in the first refrigerant circuit and configured to exchange heat with the first heat exchanger 1095*a*. The heat exchanger may further include a third heat exchanger 1096*a* located at a downstream end of the second evaporator 1050 in the second-a refrigerant circuit, and a fourth heat exchanger 1096*b* located at an upstream end of the third evaporator 1060 in the second-b refrigerant circuit and configured to exchange heat with the third heat exchanger 1096*a*.

The second heat exchanger 1095*b* and the first expansion device 1071 may be integrated with each other. The fourth heat exchanger 1096*b* and the second expansion device 1072 may be integrated with each other. The heat exchanger includes an SLHX. A degree of overheating the refrigerant sucked into the compressor 1010 may be secured through the SLHX and thus the compressor 1010 may be prevented from being broken when a liquid refrigerant flows thereinto.

The above process will be described with reference to the Mollier chart below.

The refrigeration/cooling mode in which a refrigeration chamber, i.e., the first cooling chamber 91, is cooled and the freezing/cooling mode in which a freezer, i.e., the second cooling chamber 92, is cooled may be classified according to a driving condition determined by a direction of a channel of the channel switch device 1091.

First, a flow of the refrigeration cycle 1000 in the refrigeration/cooling mode will be described with reference to the Mollier chart below.

The compressor 1010 sucks low-temperature and low-pressure vapor of a refrigerant and compresses it into high-temperature and high-pressure superheated vapor (6"→5). As the high-temperature and high-pressure superheated vapor exchanges heat with ambient air and radiates heat as it passes through the condenser 1020, the refrigerant is condensed into a liquid refrigerant or a 2-phase refrigerant (5→1).

In the refrigeration/cooling mode, the refrigerant condensed by the condenser 1020 flows through the first refrigerant circuit as the first valve 1091*a* is opened and the second valve 1091*b* is closed in the channel switch device 1091. Temperature and pressure of the refrigerant flowing through the channel switch device 1091 are decreased as the refrigerant flows through the first expansion device 1071. Furthermore, heat is transferred from the second heat exchanger 1095*b* integrally formed with the first expansion device 1071 to the first heat exchanger 1095*a* (1→9→10).

The refrigerant flowing through the first expansion device 1071 cools the refrigeration chamber, i.e., the first cooling chamber 91, as the refrigerant flows through the first evaporator 1040 (10→6). The refrigerant flowing through the first evaporator 1040 is overheated as it flows through the first heat exchanger 1095*a* (6→6"), and flows back to the compressor 1010, thereby forming the refrigeration cycle 1000.

Next, a flow of the refrigeration cycle 1000 in the freezing/cooling mode will be described with reference to the Mollier chart.

The compressor 1010 sucks low-temperature and low-pressure vapor of a refrigerant and compresses it into high-temperature and high-pressure superheated vapor (4"→5). As the high-temperature and high-pressure superheated vapor exchanges heat with ambient air and radiates heat as it passes through the condenser 1020, the refrigerant is condensed into a liquid refrigerant or a 2-phase refrigerant (5→1).

In the freezing/cooling mode, the refrigerant condensed by the condenser 1020 flows through the second refrigerant circuit as the channel switch device 1091 closes the first valve 1091*a* and opens the second valve 1091*b*. The refrigerant flowing through the channel switch device 1091 is divided into a main refrigerant and a sub-refrigerant and the main refrigerant and the sub-refrigerant respectively flow through the second-a refrigerant circuit and the second-b refrigerant circuit.

The main refrigerant flowing through the second-a refrigerant circuit flows into the nozzle entrance 1081*b* of the ejector 1080. Pressure of the main refrigerant flowing into the nozzle entrance 1081*b* is decreased through the isentropic process as the main refrigerant passes through the nozzle part 1081 of the ejector 1080, and thus a phase change occurs to change the refrigerant into a 2-phase refrigerant (1→1'). In the nozzle ejecting part 1081*c*, the main refrigerant is in a high-speed and low-pressure state.

Similarly, a pressure of the sucking channel part 1082 lying on a cross section on the same line as the nozzle ejecting part 1081*c* and disposed in a concentric form with the nozzle ejecting part 1081*c* is low. A pressure and temperature of the sub-refrigerant branching at a junction S are decreased as the sub-refrigerant passes through the second expansion device 1072, and transfers heat to the third heat exchanger 1096*a* as the sub-refrigerant passes through the fourth heat exchanger 1096*b* (1→7→8).

The sub-refrigerant cools the second cooling chamber 92 by absorbing heat from the second cooling chamber 92 as it passes through the third evaporator 1060 (8→2). The sub-refrigerant passing through the third evaporator 1060 is sucked by the sucking part 1083 of the ejector 1080. In this case, a force of sucking the refrigerant corresponds to the difference between a saturated pressure of the third evaporator 1060 and a pressure of the sucking channel part 1082 which is the same as that of the nozzle ejecting part 1081*c*. In general, a pressure of the nozzle ejecting part 1081*c* is lower than that of the sucking part 1083 and thus the sub-refrigerant is sucked into the flow of the main refrigerant (2→2').

In the mixing part 1084, the main refrigerant passing through the nozzle part 1081 and the sub-refrigerant sucked into the sucking channel part 1082 of the sucking part 1083 are mixed together to transfer the quantity of motion (1'→3' and 2'→3'). Through the diffuser part 1085, the flow velocity of the refrigerant is decreased and the pressure thereof is increased by a certain level (3'→3).

The refrigerant of the increased pressure cools the second cooling chamber 92 as it passes through the second evaporator 1050 (3→4). Thereafter, the refrigerant is overheated by heat from the fourth heat exchanger 1096*b* as it passes through the third heat exchanger 1096*a* (4→4"), and flows back to the compressor 1010, thereby forming the refrigeration cycle 1000.

While exemplary embodiments of the present invention have been illustrated and described herein, the present invention is not limited thereto and may be embodied in many different forms by those of ordinary skill in the art without departing from the scope of the invention defined in the appended claims.

The invention claimed is:

1. A refrigeration cycle comprising:

a first refrigerant circuit configured to cause a refrigerant ejected from a compressor to flow, in order, through a condenser, an ejector, a first evaporator disposed in a first cooling chamber, and a second evaporator disposed in a second cooling chamber, and then back to the compressor;

a second refrigerant circuit configured to cause the refrigerant to bypass the first evaporator in the first refrigerant circuit; and a third refrigerant circuit branching at a junction provided at a downstream end of the condenser from at least one of the first refrigerant circuit and the second refrigerant circuit, and configured to cause the refrigerant to flow from the junction through, in order, an expansion valve and a third evaporator disposed in the second cooling chamber, and then to the ejector, wherein the expansion valve includes:

a first expansion valve, and a second expansion valve disposed in series with the first expansion valve, and the third refrigerant circuit comprises:

a third-a refrigerant circuit configured to cause the refrigerant to pass through the first expansion valve provided at an upstream end of the third evaporator, and a third-b refrigerant circuit configured to cause the refrigerant to pass through the first expansion valve and the second expansion valve, the refrigerant flows through the first refrigerant circuit and the third-a refrigerant circuit in a whole cooling mode for cooling the first and second cooling chambers, and the refrigerant flows through the second refrigerant circuit and the third-b refrigerant circuit in a freezing/cooling mode for cooling the second cooling chamber to be lower than a temperature of the whole cooling mode.

2. The refrigeration cycle according to claim 1, wherein the refrigerant flows through the first refrigerant circuit or the second refrigerant circuit, and then through the third refrigerant circuit.

3. The refrigeration cycle according to claim 1, further comprising:

a first heat exchanger configured to exchange heat among the first expansion valve, the second expansion valve, and a sucking part of the compressor so as to overheat the refrigerant sucked into the compressor.

4. The refrigeration cycle according to claim 3, further comprising:

a second heat exchanger configured to exchange heat between the sucking part of the compressor and an ejecting part of the condenser.

5. The refrigeration cycle according to claim 3, further comprising:

a second heat exchanger configured to exchange heat between the sucking part of the compressor and a downstream end of the junction in the first refrigerant circuit or the second refrigerant circuit.

6. The refrigeration cycle according to claim 1, further comprising:

a third expansion valve provided at an ejecting part of the condenser; and a first heat exchanger configured to exchange heat between the third expansion valve and a sucking part of the compressor.

7. The refrigeration cycle according to claim 1, further comprising:

a first heat exchanger configured to exchange heat between a sucking part of the compressor and a downstream end of the junction in the first refrigerant circuit or the second refrigerant circuit.

8. The refrigeration cycle according to claim 1, wherein the second cooling chamber comprises a forced draft fan configured to cause air to flow through the second cooling chamber, wherein the third evaporator is provided at a downstream end of the second evaporator in a direction in which the air flows through the second cooling chamber by the forced draft fan.

9. The refrigeration cycle according to claim 1, wherein the refrigerant ejected from the condenser comprises:

a main refrigerant flowing into the ejector via the first refrigerant circuit or the second refrigerant circuit; and a sub-refrigerant branching at the junction, flowing through the third refrigerant circuit, and meeting the main refrigerant at the ejector.

10. The refrigeration cycle according to claim 1, further comprising:

a first channel switch valve configured to cause the refrigerant ejected from the ejector to flow through at least one of the first refrigerant circuit and the second refrigerant circuit; and a second channel switch valve configured to cause the refrigerant branching at the junction to the third refrigerant circuit to flow through a third-a refrigerant circuit or a third-b refrigerant circuit.

11. The refrigeration cycle according to claim 1, wherein the ejector mixes the refrigerant ejected from the condenser and the refrigerant ejected from the third evaporator, increases pressure of a result of mixing the refrigerants, and causes the result of mixing the refrigerants to flow into the compressor.

12. The refrigeration cycle according to claim 1, wherein the ejector comprises:

a nozzle part configured to reduce pressure of the refrigerant ejected from the condenser and expands the refrigerant;

a sucking part configured to suck the refrigerant ejected from the third evaporator;

a mixing part configured to mix the refrigerant flowing into the nozzle part and the refrigerant flowing into the sucking part; and a diffuser part configured to increase a pressure of a result of mixing the refrigerants in the mixing part.

13. The refrigeration cycle according to claim 12, wherein the nozzle part comprises:

a nozzle body;

a nozzle entrance through which the refrigerant flows into the nozzle body; and a nozzle ejecting part configured to eject the refrigerant from the nozzle body, the nozzle ejecting part having a width greater than a width of the nozzle entrance, and the ejector further comprises a needle unit having a cross section varying in a lengthwise direction of the ejector, and configured to be moved forward to the nozzle entrance or backward from the nozzle entrance.

14. The refrigeration cycle according to claim 4, further comprising a first heat exchanger configured to exchange heat between the first expansion valve and a sucking part of the compressor so as to overheat the refrigerant sucked into the compressor.

15. The refrigeration cycle according to claim 14, further comprising a second heat exchanger configured to exchange heat between the sucking part of the compressor and an ejecting part of the condenser.

16. The refrigeration cycle according to claim 14, further comprising a second heat exchanger configured to exchange heat between the sucking part of the compressor and a downstream end of the junction in the first refrigerant circuit or second refrigerant circuit.

17. A refrigeration cycle comprising:

a compressor;

a condenser configured to condense a refrigerant ejected from the compressor;

an ejector into which a main refrigerant which is at least a portion of the refrigerant ejected from the condenser flows;

a main evaporator into which the refrigerant ejected from the ejector flows and which ejects the refrigerant to the compressor by exchanging heat with the surroundings, the main evaporator including a first evaporator and a second evaporator, wherein the first evaporator is disposed in a first cooling chamber, and the second evaporator is disposed in a second cooling chamber which is colder than the first cooling chamber;

an expansion valve including a first expansion valve and a second expansion valve disposed in series with the first expansion valve and configured to move the remaining portion of the refrigerant ejected from the condenser;

a sub-evaporator including a third evaporator disposed in the second cooling chamber, and configured to cause the sub-refrigerant flowing through the expansion valve to pass therethrough by exchanging heat with the surroundings, and eject the sub-refrigerant to the ejector;

a first channel switch valve, coupled between an output of the ejector, an input of the first evaporator and an input of the second evaporator, configured to cause the refrigerant ejected from the ejector to pass through at least one of the first evaporator and the second evaporator; and a second channel switch valve provided at an upstream end of the expansion valve, and configured to cause the refrigerant to pass through either the first expansion valve or the first expansion valve and the second expansion valve, wherein the refrigeration cycle operates:

a whole cooling mode in which the refrigerant flows through the first, second and third evaporators and the first expansion valve to cool the first and second cooling chambers, and a freezing/cooling mode in which the refrigerant flow through the second and third evaporators and the first and second expansion valves to cool the second cooling chamber to be lower than a temperature of the whole cooling mode.

18. The refrigeration cycle according to claim 17, wherein the first channel switch valve is provided to cause the refrigerant ejected from the ejector to flow through either the first evaporator or the second evaporator.

19. The refrigeration cycle according to claim 17, wherein the ejector mixes the main refrigerant ejected from the condenser and the sub-refrigerant ejected from the sub-evaporator, increases a pressure of a result of mixing the main refrigerant and the sub-refrigerant, and transmits the result of mixing the main refrigerant and the sub-refrigerant to the compressor.

* * * * *